US009696648B2

(12) United States Patent
Maehata et al.

(10) Patent No.: US 9,696,648 B2
(45) Date of Patent: Jul. 4, 2017

(54) IMAGE FORMING APPARATUS

(71) Applicants: Yasuhiro Maehata, Tokyo (JP); Nobuo Kuwabara, Kanagawa (JP); Kenji Honjoh, Kanagawa (JP); Yasuhito Kuboshima, Tokyo (JP); Yusuke Ishizuka, Kanagawa (JP); Takeshi Shintani, Kanagawa (JP)

(72) Inventors: Yasuhiro Maehata, Tokyo (JP); Nobuo Kuwabara, Kanagawa (JP); Kenji Honjoh, Kanagawa (JP); Yasuhito Kuboshima, Tokyo (JP); Yusuke Ishizuka, Kanagawa (JP); Takeshi Shintani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/997,223

(22) Filed: Jan. 15, 2016

(65) Prior Publication Data

US 2016/0209771 A1 Jul. 21, 2016

(30) Foreign Application Priority Data

Jan. 15, 2015 (JP) ..... 2015-005771
Mar. 18, 2015 (JP) ..... 2015-054961

(51) Int. Cl.
*G03B 15/02* (2006.01)
*G03G 15/02* (2006.01)
*G03G 15/00* (2006.01)

(52) U.S. Cl.
CPC ..... *G03G 15/0216* (2013.01); *G03G 15/5008* (2013.01)

(58) Field of Classification Search
CPC ..... G03G 15/0216; G03G 15/025; G03G 15/0266
(Continued)

(56) References Cited

U.S. PATENT DOCUMENTS 5,532,795 A * 7/1996 Tatsumi ..... G03G 15/0225 399/167
2002/0076239 A1* 6/2002 Inoue ..... G03G 15/0216 399/167
(Continued)

FOREIGN PATENT DOCUMENTS

JP 6-003921 1/1994
JP 11-174781 7/1999
(Continued)

*Primary Examiner* — Rodney Fuller
(74) *Attorney, Agent, or Firm* — Duft Bornsen & Fettig, LLP

(57) ABSTRACT

An image forming apparatus includes a process cartridge that includes an image bearer including a rotary shaft and rotates about the rotary shaft; a charger to charge a surface of the image bearer; and a developing device to develop an electrostatic latent image formed on the image bearer into a visible toner image. The charger includes a charging roller that rotates about a shaft together with the image bearer during image formation and electrically charges a surface of the image bearer. A surface linear speed of the charging roller is made slower than a surface linear speed of the image bearer. The image forming apparatus includes a charging roller controller that switches the rotational speed of the charging roller to a first rotational speed slower than the linear speed of the image bearer and a second rotational speed identical to the linear speed of the image bearer.

10 Claims, 18 Drawing Sheets

(58) Field of Classification Search
USPC ..... 399/176
See application file for complete search history.

(56) References Cited

U.S. PATENT DOCUMENTS

| | | | | |
|---|---|---|---|---|
| 2004/0253020 | A1* | 12/2004 | Noh | G03G 15/757 399/167 |
| 2008/0219702 | A1* | 9/2008 | Tsukamoto | G03G 15/0126 399/168 |
| 2010/0226671 | A1* | 9/2010 | Mizushima | G03G 15/10 399/51 |
| 2014/0168338 | A1* | 6/2014 | Yano | G03G 15/0189 347/116 |

FOREIGN PATENT DOCUMENTS

| | | | |
|---|---|---|---|
| JP | 2003-122098 | | 4/2003 |
| JP | 2003122098 | A * | 4/2003 |
| JP | 2007-065485 | | 3/2007 |
| JP | 2007-334119 | | 12/2007 |
| JP | 2008-040150 | | 2/2008 |

* cited by examiner

IMAGE FORMING APPARATUS

CROSS-REFERENCE TO RELATED APPLICATIONS

The present application claims priority pursuant to 35 U.S.C. §119(a) from Japanese patent application numbers 2015-005771 and 2015-054961, filed on Jan. 15, 2015, and Mar. 18, 2015, the entire disclosure of each of which is incorporated by reference herein.

BACKGROUND

Technical Field

The present invention relates to an image forming apparatus, and in particular to an electrophotographic image forming apparatus that forms images electrophotographically.

Description of the Related Art

Although the photoconductive image bearer and developing roller employed in an electrophotographic image forming apparatus are cylindrical, this cylindrical shape is not perfect. These imperfections cause density variation in the toner image during image formation.

A charging bias applied to the charging roller and the charging bias applied to the developing roller are corrected to compensate for these imperfections in the image bearer and the developing roller, thereby suppressing image density variation.

However, adjustment of the charging bias to compensate for the effect of imperfections in parts such as the image bearer and the developing roller is generally insufficient, resulting in abnormal images generated due to density variation in the toner image keyed to the rotary cycle of the charging roller.

It is possible to employ a structure that reduces the charge variation generated due to fluctuation in the size of a gap between the image bearer and the charging roller, or a structure in which a rotational speed of the charging roller is variable. The problem, however, is that such imperfections in the charging roller include not only the shape of the charging roller but also the electrical resistance thereof.

Further, having to provide a structure to rotate the charging roller and another structure to detect a gap between the image forming apparatus and the charging roller to control the rotational speed of the charging roller complicates the image forming apparatus.

SUMMARY

In one exemplary embodiment of this disclosure, an optimal image forming apparatus is provided that has a process cartridge that includes an image bearer including a rotary shaft and which rotates about the rotary shaft; a charger to charge a surface of the image bearer; and a developing device to develop an electrostatic latent image formed on the image bearer as a visible toner image. The charger includes a charging roller, the charging roller rotates about a shaft together with the image bearer during image formation, and electrically charges a surface of the image bearer, and a surface linear speed of the charging roller is made slower than a surface linear speed of the image bearer.

In another exemplary embodiment of the disclosure there is provided an image forming apparatus including a charging roller to rotate at a predetermined rotational speed; an image bearer to rotate at a predetermined rotational speed; and a charging roller controller to switch the rotational speed of the charging roller between a first rotational speed and a second rotational speed during image formation. The charging roller controller switches the rotational speed of the charging roller to the first rotational speed, which is slower than the linear speed of the image bearer, and the second rotational speed, which is the same as the linear speed of the image bearer.

These and other objects, features, and advantages of the present invention will become apparent upon consideration of the following description of the preferred embodiments of the present invention when taken in conjunction with the accompanying drawings.

DETAILED DESCRIPTION

Hereinafter, embodiments of the present invention will be described with reference to drawings.

First Embodiment

Figure 1:
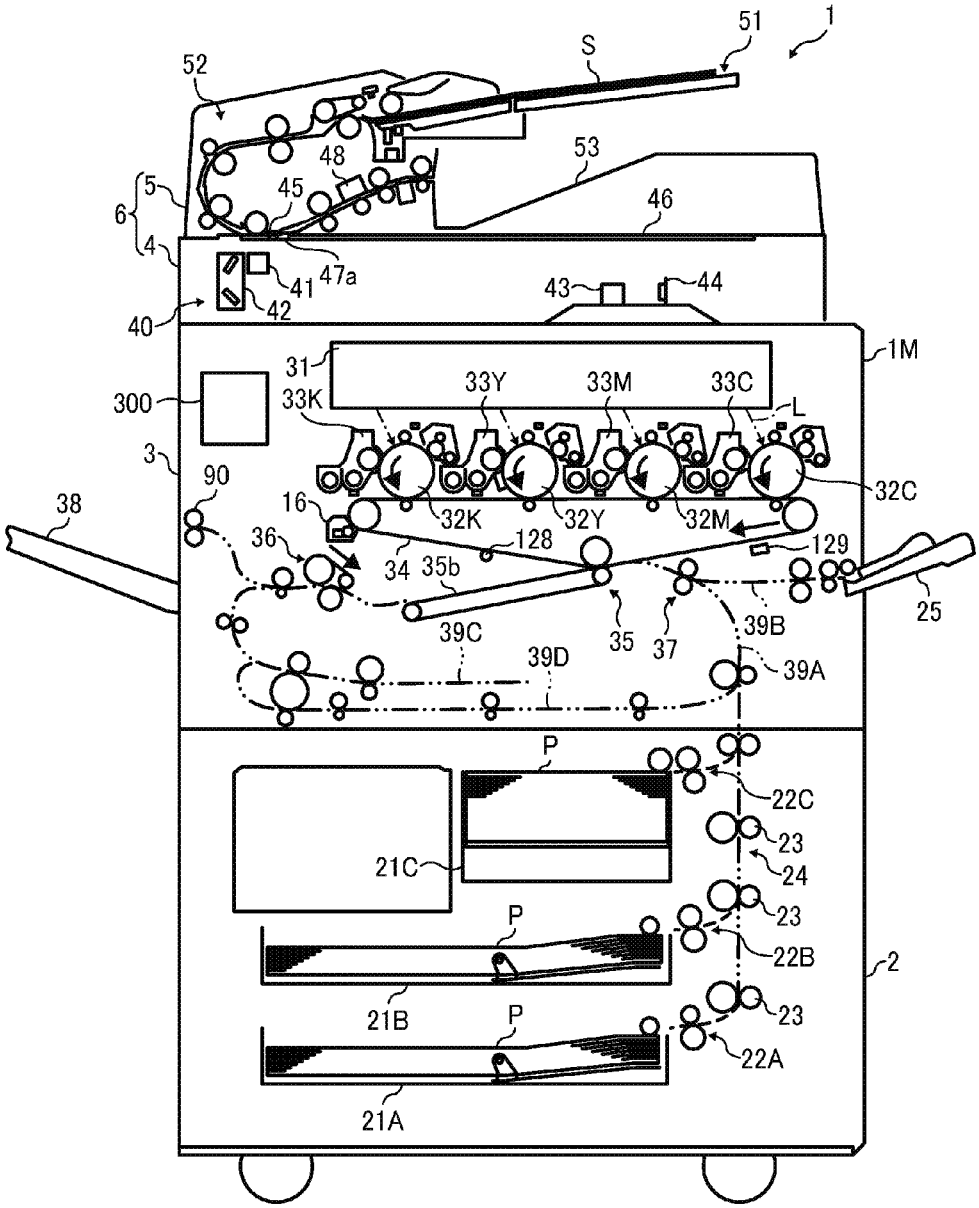
FIG. 1 is a cross-sectional front view illustrating a schematic structure of an image forming apparatus according to an embodiment of the present invention.

As illustrated in FIG. 1, an image forming apparatus 1, a digital multifunction apparatus, according to the present embodiment includes an apparatus body 1M that includes a sheet feed section 2; an image forming section 3; and an image reading section 4, and an automatic document feeder (hereinafter, ADF) 5 disposed on the apparatus body 1M. The image reading section 4 and the ADF 5 form an image reading device 6.

The sheet feed section 2 includes a plurality of sheet cassettes 21A, 21B, and 21C, each of which can stack cut-sheet shaped transfer sheets P in layers. The transfer sheet P of a preselected sheet size from a plurality of sheet sizes is contained in each of the sheet cassettes 21A, 21B, and 21C with a vertical or horizontal sheet feed direction.

The sheet feed section 2 includes sheet feed devices 22A, 22B, and 22C, each to pick up, separate, and feed the sheet P contained in the sheet cassettes 21A, 21B, and 21C sequentially from a top sheet. The sheet feed section 2 further includes various rollers 23, through which a sheet feed path 24 to feed the transfer sheet P from each of the sheet feed devices 22A, 22B, and 22C to a predetermined image forming position of the image forming section 3 is formed.

The image forming section 3 includes an exposure device 31, image bearers 32K, 32Y, 32M, and 32C, and developing devices 33K, 33Y, 33M, and 33C, in which toner of respective colors of black (K), yellow (Y), magenta (M), and cyan (C) is filled. In addition, the image forming section 3 includes a primary transfer section 34, a secondary transfer section 35, and a fixing device 36.

The exposure device 31 generates laser beams L for exposure of each color based on an image read by the image reading device 6. In addition, the exposure device 31 exposes the laser beams to the image bearers 32K, 32Y, 32M, and 32C of each color, to thereby form an electrostatic latent image of each color corresponding to a read image on a surface of each of the image bearers 32K, 32Y, 32M, and 32C.

The developing devices 33K, 33Y, 33M, and 33C supply toner in a thin layer to corresponding image bearers 32K, 32Y, 32M, and 32C, and develop and render the electrostatic latent image formed on the image bearers 32K, 32Y, 32M, and 32C visible as a toner image.

In the image forming section 3, the developed toner image on each of the image bearers 32K, 32Y, 32M, and 32C is primarily transferred to the primary transfer section 34, and the toner image is secondarily transferred to the transfer sheet P in the secondary transfer section 35 closely contacting the primary transfer section 34. In addition, in the image forming section 3, the secondarily transferred toner image on the transfer sheet P is heated and pressed in the fixing device 36, so that a color image is fixed onto the transfer sheet P and is recorded.

The image forming section 3 includes a sheet feed path 39A to convey the transfer sheet P that has been conveyed from the sheet feed section 2 through the sheet feed path 24, to the secondary transfer section 35. In the sheet feed path 39A, first, timing and speed of feeding the transfer sheet P are adjusted in a registration roller pair 37. Then, the transfer sheet P having passed the secondary transfer section 35 and the fixing device 36 in synchrony with the belt speed at the primary transfer section 34 and the secondary transfer section 35, is ejected onto a sheet ejection tray 38.

The image forming section 3 also includes a manual sheet feed path 39B to feed a transfer sheet placed on a manual tray 25 at upstream of the registration roller pair 37 to the sheet feed path 39A.

A switchback sheet feed path 39C and a reversing sheet feed path 39D each including a plurality of feed rollers and feed guides are disposed below the secondary transfer section 35 and the fixing device 36.

The switchback sheet feed path 39C performs switchback feeding in which, when forming an image on both sides of the transfer sheet P, the transfer sheet P on one side of which image fixation has been completed is fed from one edge side, and the transfer sheet P is retracted or moved in the opposite direction to an entering direction.

The reversing sheet feed path 39D reverses the front and back side of the transfer sheet P that has been switched back by the switchback sheet feed path 39C, and refeeds the transfer sheet P to the registration roller pair 37.

The transfer sheet P that has completed image fixing process of one side thereof is switched so that its forwarding direction is the opposite direction by the switchback sheet feed path 39C and the reversing sheet feed path 39D, and is reversed upside down, and re-enters the secondary transfer nip. Then, the other side of the transfer sheet P is subjected to the secondary transfer process and the fixing process, and is ejected to the sheet ejection tray 38.

The image reading section 4 includes a first carriage 41 including a light source and mirrors, a second carriage 42 including mirrors, an imaging lens 43, a pickup device 44, and a first contact glass 45. The above parts form a first side reader 40 to read an image on one side of the original sheet S conveyed onto the first contact glass 45. Herein, the first side means one of the sides, for example, a surface side of the automatically conveyed original sheet S.

The image reading section 4 includes a second contact glass 46 on which the original sheet S is placed, and a contact member 47*a* that can contact and position one side of the original sheet S.

The first carriage 41 is so disposed below the first contact glass 45 and the second contact glass 46 as to be movable laterally in the figure and to be positionally adjustable, in which irradiation light from the light source is reflected by mirrors to irradiate to an exposure surface. The reflected light reflected by the original sheet S passes through each mirror mounted on the first carriage 41 and the second carriage 42, to be incident to the imaging lens 43 to be focused, and the focused image is read by the pickup device 44.

The image reading section 4 moves the first carriage 41 and the second carriage 42 at a speed ratio of 2 to 1, for example, with the light source activated, so that an image surface of the original sheet S placed on the second contact glass 46 can be exposed and scanned. The image reading section 4 exerts a fixed original reading function (that is, a so-called flatbed scanner function) by reading the original image by the pickup device 44 in the exposure scanning process.

The image reading section 4 stops the first carriage 41 at a fixed position directly below the first contact glass 45. The image reading section 4 provides a moving original reading function (that is, a so-called DF scanning function) to read the first side image of the original sheet S being automatically conveyed, without moving the optical system formed of the light source and reflection mirrors.

The image forming apparatus 1 includes the first side reader 40 in the image reading section 4, and a second side reader 48 incorporated in the ADF 5. The second side reader 48 is configured to scan a second side, that is, a backside image surface of the original sheet S that has passed the first contact glass 45, for example.

The ADF 5 is connected to an upper portion of the apparatus body 1M of the image forming apparatus 1 via hinge mechanisms. The ADF 5 is hinged, and opens between an open position where the first contact glass 45 and the second contact glass 46 in the image reading section 4 are exposed, and a closed position covering the first contact glass 45 and the second contact glass 46.

The ADF 5 is configured as a sheet-through automatic document feeder. The ADF 5 includes a document table 51 as an original platen, a document feed section 52 including various rollers and guides, and an original sheet ejection tray 53 to collect the original sheet S after image formation.

Figure 2:
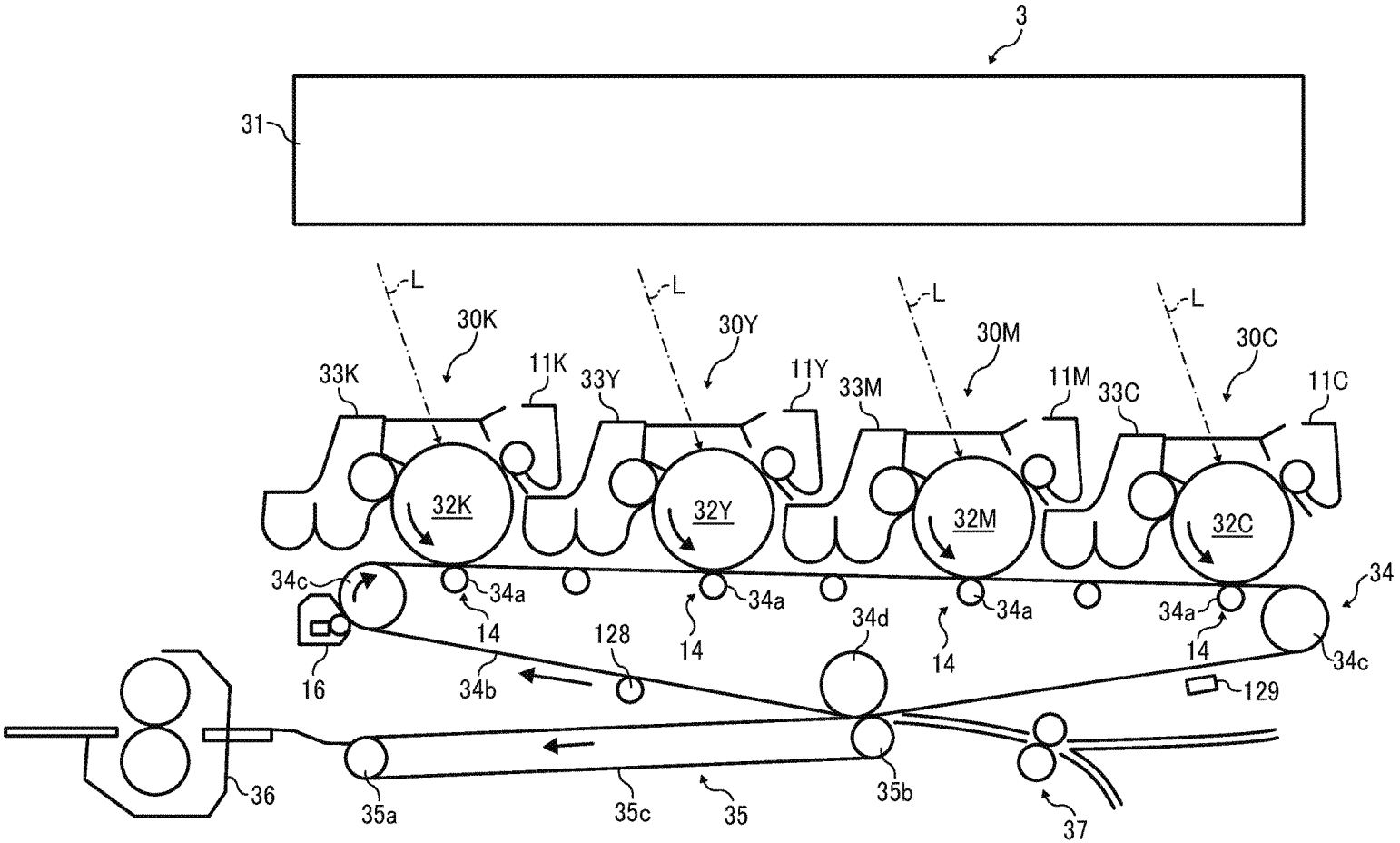
FIG. 2 illustrates a schematic structure of an image forming section in the image forming apparatus according to the embodiment of the present invention.

As illustrated in FIG. 2, the image forming section 3 includes the exposure device 31, image bearers 32K, 32Y, 32M, and 32C, and developing devices 33K, 33Y, 33M, and 33C, in which toner of respective colors of black (K), yellow (Y), magenta (M), and cyan (C) is filled. In addition, the image forming section 3 includes the primary transfer section 34, the secondary transfer section 35, and the fixing device 36.

The image bearers 32K, 32Y, 32M, and 32C and the developing devices 33K, 33Y, 33M, and 33C together with drum cleaners 11K, 11Y, 11M, and 11C construct process cartridges 30K, 30Y, 30C, and 30C, respectively. These process cartridges 30K, 30Y, 30C, and 30C are similarly configured to each other except that the color of toner each process cartridge handles is different.

The exposure device 31 generates laser beams L for exposure of each color based on an image read by the image reading device 6. The exposure device 31 exposes the image bearers 32K, 32Y, 32M, and 32C of each color with the laser beams, to thereby form an electrostatic latent image of each color corresponding to a read image on a surface of each of the image bearers 32K, 32Y, 32M, and 32C.

The developing devices 33K, 33Y, 33M, and 33C supply toner in a thin layer to a corresponding one of image bearers 32K, 32Y, 32M, and 32C, and develop and render the electrostatic latent image formed on the image bearers 32K, 32Y, 32M, and 32C visible as a toner image.

In the image forming section 3, the developed toner image on each of the image bearers 32K, 32Y, 32M, and 32C is primarily transferred to the primary transfer section 34, and the toner image is secondarily transferred to the transfer sheet P in the secondary transfer section 35 closely contacting the primary transfer section 34. In addition, in the image forming section 3, the secondarily transferred toner image on the transfer sheet P is heated and pressed in the fixing device 36, so that a color image is fixed onto the transfer sheet P and is recorded.

In the primary transfer section 34, a transfer unit 14 is formed below each image bearer 32 included in each of the four process cartridges 30K, 30Y, 30C, and 30C.

Each transfer unit 14 causes an endless intermediate transfer belt 34*b* entrained around feed rollers 34*c*, 34*d* and a primary transfer roller 34*a*, to cyclically move in the clockwise direction in FIG. 2 while contacting the image bearers 32K, 32Y, 32M, and 32C. With this structure, a primary transfer nip for Y-, M-, C-, and K-color is formed at each portion where each of the image bearers 32K, 32Y, 32M, and 32C contacts the intermediate transfer belt 34*b*.

Each primary transfer roller 34*a* for each color disposed inside a loop of the intermediate transfer belt 34*b* presses the intermediate transfer belt 34*b* against the corresponding image bearers 32K, 32Y, 32M, and 32C near the primary transfer nip. These primary transfer rollers 34*a* are each supplied with a primary transfer bias from a power supply. With this structure, a primary transfer electric field to electrostatically move the toner image formed on the image bearers 32K, 32Y, 32M, and 32C toward the intermediate transfer belt 34*b* is formed at each primary transfer nip for Y-, M-, C-, and K-color.

Each toner image is sequentially superimposed, at each transfer nip, on an outer surface of the intermediate transfer belt 34*b* that sequentially passes through the primary transfer nip for each color according to the clockwise, cyclical move, in the primary transfer. With this superimposing primary transfer, a four-color superimposed toner image is formed on the outer surface of the intermediate transfer belt 34*b*.

The secondary transfer section 35 includes an endless sheet feed belt 35*c* which is stretched between a drive roller 35*a* and a secondary transfer roller 35*b* disposed closely to the feed roller 34*d* of the primary transfer section 34, so that the sheet feed belt 35*c* cyclically moves according to the rotation of the drive roller 35*a*.

The intermediate transfer belt 34*b* of the primary transfer section 34 and the sheet feed belt 35*c* of the secondary transfer section 35 are sandwiched between the feed roller 34*d* of the primary transfer section 34 and the secondary transfer roller 35*b* of the secondary transfer section 35. With this structure, a secondary transfer nip is formed at the portion where the outer surface of the intermediate transfer belt 34*b* contacts the outer surface of the sheet feed belt 35*c*.

A secondary transfer bias is applied to the secondary transfer roller 35*b* from the power source. In addition, the lower feed roller 34*d* of the primary transfer section 34 is grounded. Accordingly, a secondary transfer electric field is formed at the secondary transfer nip.

Then, the transfer sheet P is fed by the registration roller pair 37 at a speed equal to the cyclical move of the intermediate transfer belt 34*b* and at a timing in synchronization with the four color toner image on the intermediate transfer belt 34*b*

In the secondary transfer nip, the four-color toner image on the intermediate transfer belt 34*b* is transferred en bloc onto the transfer sheet P by the secondary transfer electric field and nip pressure, so that a full-color toner image is formed on the recording sheet P with added performance of white color of the recording sheet.

The transfer sheet P that has passed through the secondary transfer nip is separated from the surface of the intermediate transfer belt 34*b* and is conveyed to a fixing device 36 while being held on the outer surface of the sheet feed belt 35*c*. Residual toner not transferred to the recording sheet P in the secondary transfer nip adheres to a surface of the intermediate transfer belt 34*b* that has passed through the secondary transfer nip. The residual toner is scraped off by a belt cleaner 16 that contacts the intermediate transfer belt 34*b*.

When the transfer sheet P is conveyed to the fixing device 36, the fixing device 36 fixes the full-color image on the recording sheet P with heat and pressure, and the recording sheet P is sent from the fixing device 36 to a sheet ejection roller pair and is ejected onto the sheet ejection tray 38 outside the copier.

Figure 3:
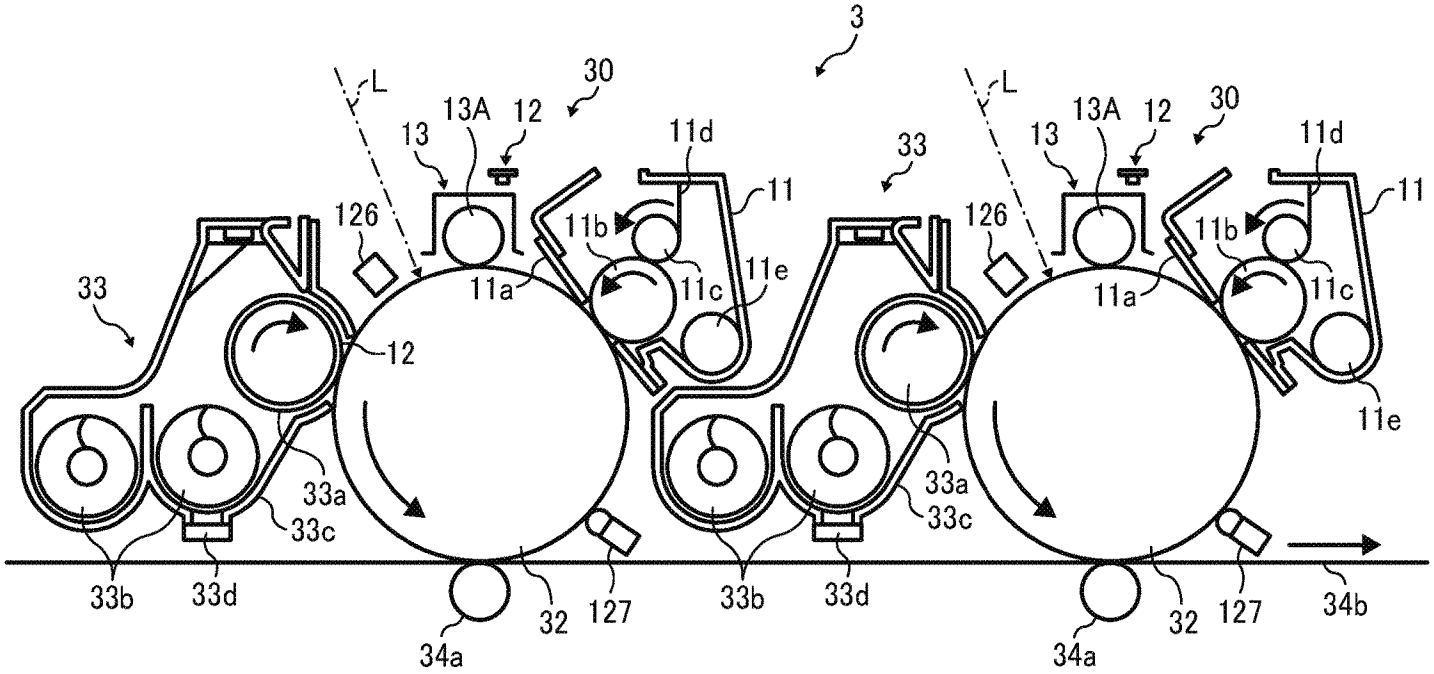
FIG. 3 illustrates a schematic structure of a process cartridge in the image forming apparatus according to the embodiment of the present invention.

As illustrated in FIG. 3, the process cartridges 30K, 30Y, 30C, and 30C in the image forming section 3 are similarly configured to each other except that the color of toner each process cartridge handles is different. Accordingly, codes of K, Y, M, and C representing each color of the adjacent process cartridges 30 are omitted in FIG. 3.

Each process cartridge 30 includes an image bearer 32 and a developing device 33, and a drum cleaner 11, a discharger 12, a charger 13, and a lubricant applicator 127 that are disposed around the image bearer 32 so as to be attachable to and detachable from the image bearer 32. Each process cartridge is detachably attachable to the apparatus body 1M of the image forming apparatus 1.

In the process cartridge 30, the exposure device 31 of the apparatus body 1M exposes the surface of the image bearer 32 that has been charged by the charging roller 13A mounted on the charger 13, with laser beams L, to thereby form an electrostatic latent image. The latent image is rendered visible with toner by the developing device 33 to which a predetermined amount of toner is replenished from a toner bottle each including one of colors of toner including yellow, magenta, cyan, and black. The visible toner image is then transferred onto the intermediate transfer belt 34*b* by the primary transfer roller 34*a*. The residual toner remaining on the image bearer 32 after transfer is collected by the drum cleaner 11, and is conveyed through a conveyance path inside the drum cleaner 11, to a toner recycling bin disposed in the apparatus body 1M. After collection of the residual toner by the drum cleaner 11, the lubricant applicator 127 applies a lubricant on the surface of the image bearer 32, to thus form a protective layer thereon.

Specifically, a yellow, magenta, cyan, and black toner is sequentially transferred from the image bearer 32 of each process cartridge 30 on the intermediate transfer belt 34*b*. In this case, each image forming operation of each color is shifted in time from upstream to downstream in the rotation direction so that each toner image is superimposed on the same position on the intermediate transfer belt 34*b*. The toner image formed on the intermediate transfer belt 34*b* is transferred to the secondary transfer section 35 and is secondarily transferred to the transfer sheet P, being a recording medium conveyed at a proper timing from the sheet feed device. The residual toner remaining on the intermediate transfer belt 34*b* after the secondary transfer, is collected by a cleaner 128, and is conveyed to a toner recycling bin disposed in the apparatus body 1M, in the same manner as the drum cleaner 11 of the process cartridge 30. The transfer sheet P on which the toner image is transferred is conveyed to the fixing device 36 where the toner image is fixed onto the transfer sheet P with heat, and is ejected by a sheet ejection roller 67.

Hereinafter, the process cartridge 30 and constituent parts will now be described.

In each process cartridge 30, the image bearer 32 is drum-shaped and includes a base tube formed of aluminum, and a photosensitive layer with organic photosensitizing agent having photosensitivity coated on the base tube.

The exposure device 31 exposes each surface of the image bearers 32 with laser beams L, to thereby form an electrostatic latent image of each color corresponding to a read image on the surface of the image bearers 32 charged by the charging roller 13A.

The developing device 33 includes a development case 33*c* that incorporates two-component developer formed of magnetic carriers and non-magnetic toner, and an agitation screw 33*b* to supply the two-component developer to the development sleeve 33*a* while agitating the two-component developer.

The developing device 33 includes a magnet disposed inside the development sleeve 33*a*, so that a part of the toner contained in the two-component developer is carried on the development sleeve 33*a* in a thin layer. With this, the toner in the thin layer form on the development sleeve can be transferred onto the electrostatic latent image formed on the image bearer 32.

The residual toner after development returns again inside the development case 33*c* following the rotation of the development sleeve 33*a*, and is separated from the surface of the development sleeve 33*a* due to magnetic repulsion. An appropriate amount of toner is supplied to the two-component developer based on a toner density detected by a toner density sensor 33*d* disposed inside the development case 33*c*.

The drum cleaner 11 employs a cleaning blade 11*a* formed of polyurethane rubber that presses an outer circumferential surface of the image bearer 32, and a conductive fur brush 11*b* that contacts the outer circumferential surface of the image bearer 32. In addition, the drum cleaner 11 includes a metallic electric field roller 11*c* that rotates in an opposite direction contacting the fur brush 11*b*, a scraper 11*d* that presses the electric field roller 11*c*, and a collection screw 11*e* disposed below the scraper 11*d*.

The residual toner remaining on the image bearer 32 after transferring the toner image is collected by the drum cleaner 11. The electric field roller 11*c* applies a bias voltage to the fur brush 11*b*.

The residual toner remaining on the outer circumferential surface of the image bearer 32 adheres to the fur brush 11*b* first, moves to the electric field roller 11*c*, and is scraped off by the scraper 11*d*. The thus scraped-off toner is transferred from inside the drum cleaner 11 to an outside recycle conveyance device via the collection screw 11*e*.

The discharger 12 electrically discharges the cleaned surface of the image bearer 32, with irradiation of light. The charging roller 13A formed in a roller shape electrically charges the discharged surface of the image bearer 32 uniformly. The uniformly-charged outer circumferential surface of the image bearer 32 is subjected to an optical writing process by laser beams L from the exposure device 31. The lubricant applicator 127 applies a lubricant to the surface of the image bearer 32 to thereby protect the surface thereof.

The primary transfer roller 34*a* is disposed below each of the image bearer 32 and allows the endless intermediate transfer belt 34*b* to cyclically rotate while contacting the image bearer 32.

Figure 4:
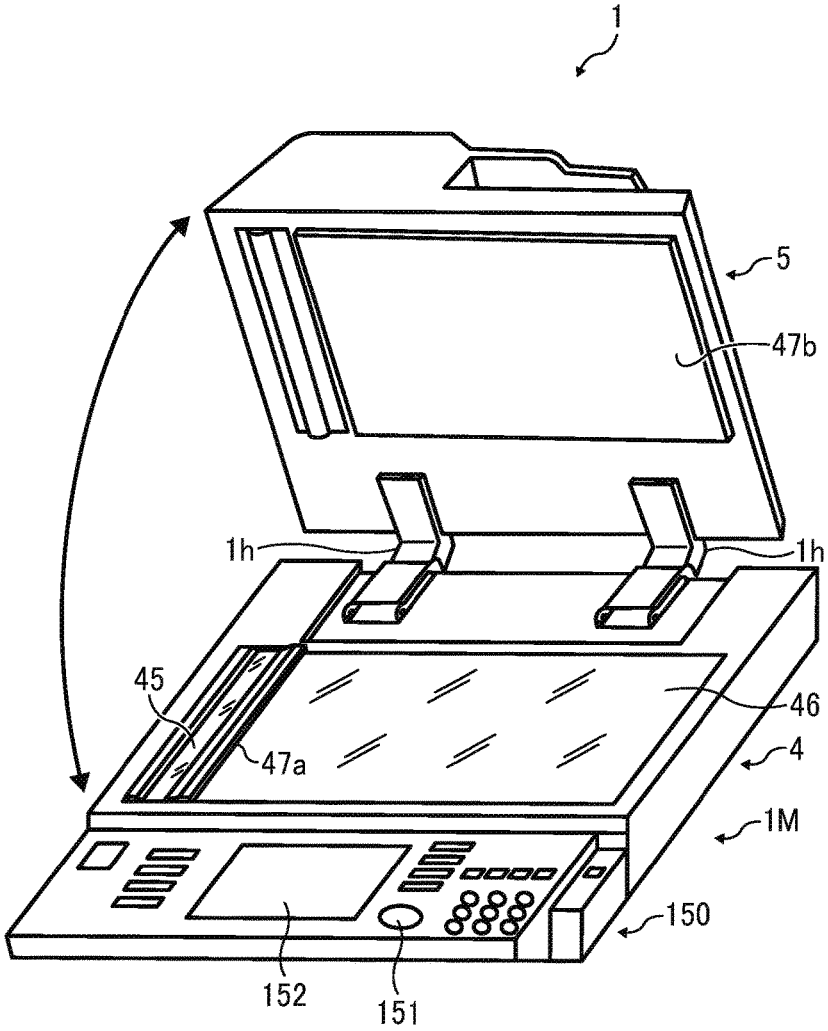
FIG. 4 is a perspective view illustrating a hinge portion between an apparatus body of the image forming apparatus and an automatic document feeder according to the present embodiment of the present invention.

As illustrated in FIG. 4, the image reading section 4 is disposed above the apparatus body 1M of the image forming apparatus 1. The image reading section 4 includes a first contact glass 45 that positions on the sheet feed path of the original sheet S, a second contact glass 46 on which the original sheet S is placed, and a contact member 47*a* that can contact and position one side of the original sheet S.

In addition, a control panel 150 is disposed at a front side on the apparatus body 1M. The control panel 150 includes a print button 151 and a touch panel 152. When the print button 151 is pressed, copying operation of the image forming apparatus 1 is started.

The ADF 5 is connected to an upper portion of the apparatus body 1M of the image forming apparatus 1 via a hinge mechanism 1*h*, to be openably closable. A document holder 47*b* is mounted on the bottom surface of the ADF 5. The ADF 5 is hinged, and opens between an open position where the first contact glass 45 and the second contact glass 46 in the image reading section 4 are exposed, and a closed position covering the first contact glass 45 and the second contact glass 46.

Figure 5:
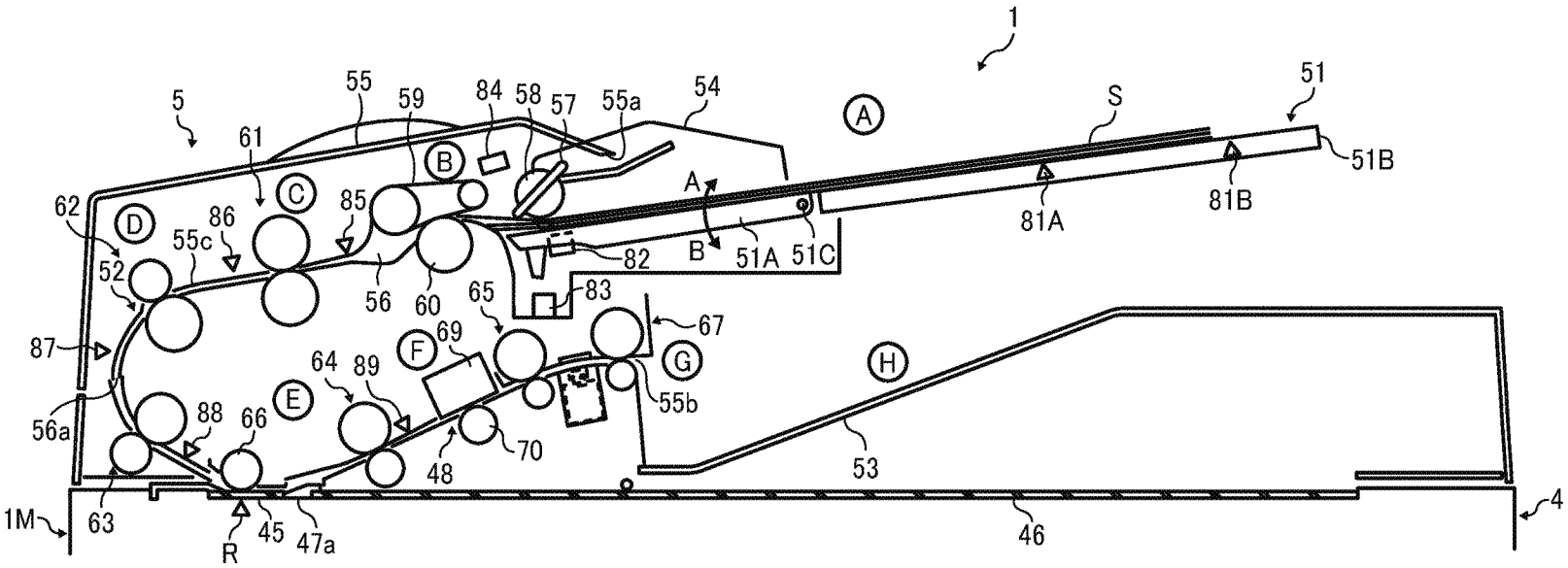
FIG. 5 illustrates a schematic structure of the automatic document feeder in the image forming apparatus according to the embodiment of the present invention.

As illustrated in FIG. 5, the ADF 5 is configured as a sheet-through automatic document feeder. Then, the ADF 5 includes a document table 51 as a document platen, the document feed section 52 including various rollers and guides, and a document ejection tray 53 to collect the original sheet S after image formation.

The ADF 5 includes various functional parts including a document setter A, a separation feed section B, a registration section C, a turning section D, a first read and feed section E, a second read and feed section F, an outlet G, and a stacker H.

The document setter A is formed of a board shape, on which at least one cut sheet-shaped original sheet S or a stack of a plurality of original sheets *S can* be stacked. When the original sheet S is one-sided document, the original sheet S is placed on the document setter A with its surface side faced up.

The separation feed section B separates a topmost sheet from the stack of the original sheets S placed on the document setter A, and feeds it to an inlet to a document feed path 56, which will be described later.

The registration section C serves to contact the original sheet S sequentially fed from the separation feed section B and align the sheet S to a predetermined feed posture, and also serves to pull and feed the sheet S to downstream after the alignment.

The turning section D switches the surface of the original sheet S that has been pulled and fed from the registration section C, to reverse upside down to face down in FIG. 5.

The first read and feed section E passes the original sheet S, after folding back from the turning section D, through a reading position above the first contact glass 45 at a predetermined speed in a sub-scanning direction (that is, a direction perpendicular to a main scanning direction corresponding to a width direction of the original sheet S).

The second read and feed section F, if the original sheet S is a double-sided document, scans a backside image more downstream in the main scanning direction via the platen glass from obliquely left above, than the main scan position of the surface image, and conveys the original sheet S at a predetermined speed in the sub-scanning direction.

The outlet G ejects the original sheet S that has been scanned in the first read and feed section E and the second read and feed section F, to the side of the stacker H.

The stacker H sequentially stacks the original sheet S that is sequentially ejected from the outlet G, with the surface side thereof faced down. The original sheet S stacked on the stacker H is stacked in the same order when the same was stacked on the document setter A, and in a reverse direction as a whole stack with its original side faced down.

The document setter A, separation feed section B, registration section C, turning section D, first read and feed section E, second read and feed section F, outlet G, and stacker H are controlled by a controller for controlling the ADF.

The ADF 5 separates a topmost sheet from the stack of the original sheets S placed on the document setter A, and the document feed section 52 feeds it via a predetermined feed path to pass above the first contact glass 45. Further, the ADF 5 is configured such that the image reading section 4 reads the image on the original sheet S when the sheet S passes through the first contact glass 45, and then the original sheet S is ejected onto the document ejection tray 53.

The document table 51, on which the original sheet S is placed with the surface side faced up, is disposed with a slope, with its leading end lowered and its rear end elevated.

The document table 51 is divided into two, a movable document table 51A and a rear document table 51B. A leading end of the movable document table 51A inclines pivotally about a shaft 51C as a rotary center, depending on a thickness of a stack of the original sheet S. The movable document table 51 vertically rotates in directions A and B as indicated by a double-headed arrow in FIG. 5 by operating a bottom plate elevation motor, which will be described later.

The movable document table 51A includes a side guide plate 54 to define a lateral direction perpendicular to a sheet feed direction of the original sheet S directing to the document feed section 52. The side guide plate 54 is formed of a pair of guide plates disposed relatively approaching to and separating from each other in the width direction of the movable document table 51A, so that the movable document table 51A coincides with the reference position in the width direction of the original sheet S.

The document feed section 52 is covered by a cover 55, at least an upper portion of which is formed to open and close. The cover 55 includes a sheet inlet 55*a* through which a leading end of the original sheet S is forwarded to an inner side of the cover 55. In addition, the cover 55 covers the leading end of the movable document table 51A so that the leading end of the movable document table 51A positions more in the back of the sheet inlet 55*a*.

The document feed section 52 extends from the sheet inlet 55*a* to a sheet outlet 55*b* which is covered by a rib 55*c* and other guide members formed on the cover 55 and the like, to form a document feed path 56.

The document feed section 52 includes a set feeler 57 that rotates when the original sheet S is placed on the movable document table 51A. The set feeler 57 is disposed above the leading end of the movable document table 51A, which is an upstream end of the sheet inlet 55*a* with reference to the sheet feed direction of the original sheet S. In addition, the document feed section 52 includes a pickup roller 58 disposed in the vicinity of and in an internal side of the sheet inlet 55*a*, an endless sheet feed belt 59 disposed opposite with the document feed path 56 interposed, and a reverse roller 60 serving as a sheet feeder.

The pickup roller 58 is driven by a pickup motor, which will be described later, contacts a topmost sheet S, and picks up a few original sheets S from the topmost ones (ideally one sheet S) by friction from the original sheet S stacked on the document table 51.

The sheet feed belt 59 rotates while being driven by a sheet feed motor, which will be described later, and moves along the document feed direction.

The reverse roller 60 rotates in the direction opposite the document feed direction of the sheet feed belt 59, and includes a torque limiter. The reverse roller 60 contacts the sheet feed belt 59 with a predetermined pressure, and rotates in the counterclockwise direction following the rotation of the sheet feed belt 59 while directly contacting the sheet feed belt 59 or contacting the sheet feed belt 59 with a piece of original sheet S interposed in between.

Upon multiple sheets S entering a portion between the sheet feed belt 59 and the reverse roller 60, a rotational force of the reverse roller 60 in the counterclockwise direction declines compared to a predetermined torque of a torque limiter. Thus, the reverse roller 60 pushes back extra sheets S, thereby preventing multiple sheets S from being fed.

The document feed section 52 includes multiple pairs of feed rollers 61 to 65 to nip and feed the original sheet S opposing the original sheet S with the document feed path 56 in between. Each pair of feed rollers 61 to 65 includes a pair of rollers or a large roller and a small roller that forms a nip while closely contacting each other, and the number of rollers available in the shaft direction is arbitrary. The number and location of these feed rollers 61 to 65 are arbitrarily set in accordance with the length of the smallest original sheet S in the document feed direction allowable in the ADF 5.

The feed roller 61 disposed adjacent to the downstream side of the sheet feed belt 59 serves as a pullout roller. Specifically, the feed roller 61 contacts a leading end of the fed original sheet S matched with a drive timing of the pickup roller 58, thereby correcting a skew of the sheet S, and the feed roller 61 pulls out the original sheet S after correction of skew to further feed the original sheet S.

The feed roller 61 serves to feed the original sheet S up to the feed roller 62 disposed at a midpoint, and is driven by a reverse rotation of the sheet feed motor. When the sheet feed motor rotates reversely, the feed rollers 61 and 62 are driven, but the pickup roller 58 and the sheet feed belt 59 are not driven.

In addition, the feed roller 62 is a turn roller to allow the original sheet S that has been pulled out and fed, to enter a turning part 56*a* in the midpoint of the document feed path 56.

The feed rollers 61 and 62 allow the original sheet S fed from the registration section C to the turning section D, to be fed at a higher speed than in the first read and feed section E, so that the process time of the original sheet S fed into the first read and feed section E is shortened.

The feed roller 63 disposed downstream of the turning part 56*a* of the document feed path 56 serves as a reading inlet roller to sequentially feed the original sheet S that has passed the turning part 56*a* onto the first contact glass 45. Upon passing through the first contact glass 45, the original sheet S is fed to the second side reader 48 by the feed roller 64 serving as the first reading outlet roller, and is further fed to the sheet outlet 55*b* by the feed roller 65 disposed downstream of the second reading out roller.

The document feed section 52 includes a first reading roller 66 disposed opposite and above the first contact glass 45; and an ejection roller 67, disposed in the vicinity of the sheet outlet 55*b*, to eject the original sheet S from the sheet outlet 55*b* to the document ejection tray 53.

The first reading roller 66 is pressed against the first contact glass 45 by a biasing member such as a coil spring. The first reading roller 66 moves the original sheet S entering onto the first contact glass 45 down the stream while allowing the original sheet S to contact the first contact glass 45.

The document feed section 52 includes the second side reader 48 disposed downstream of the first reading roller 66 and at a relatively linear sheet feed area between the feed roller 64 and the feed roller 65.

The second side reader 48 includes a backside scan unit 69 to scan an image in the backside of the original sheet S; a shading roller 70 disposed opposite the backside scan unit 69 with the document feed path 56 in between; and a feed gap adjuster.

The backside scan unit 69 is formed of, for example, a contact image sensor (CIS), and reads the image on the backside (a second side) of the original sheet S after the pickup device 44 of the image reading section 4 has read the image on the front side (of a first side) of the original sheet S.

The shading roller 70 suppresses floating of the original sheet S in the backside scan unit 69, and serves as a reference white to obtain shading data in the backside scan unit 69. The original sheet S passes through the backside scan unit 69 without any processing when reading of the backside image is not necessary.

The feed gap adjuster is attached to, for example, a shaft bearing to support the shading roller 70, and adjusts a gap between the backside scan unit 69 and the shading roller 70. With this structure, the depth of focus of the backside scan unit 69 can be adjusted to within a range in which the reading image quality is not degraded.

The document table 51 includes a first original length sensor 81A and a second original length sensor 81B each to detect whether the original sheet S is placed vertically or laterally on the document table 51. These sensors are spaced apart along the sheet feed direction.

The first original length sensor 81A and the second original length sensor 81B are configured to detect a size of the original sheet S placed on the document table 51 by using another sensor to detect a distance from the side guide plate 54 in combination.

An original set sensor 82 disposed near the leading end bottom surface of the document table 51, detects a lowest portion on the moving locus of the leading end of the set feeler 57, to thereby detect whether or not the original sheet S is placed on the document table 51. The original set sensor 82 is configured to detect the lowest portion on the moving locus of the leading end of the set feeler 57.

A home position sensor 83 is disposed at a bottom of the leading end of the movable document table 51A. The home position sensor 83 detects that the movable document table 51A rotates downward to reach a home position.

The document feed section 52 includes, from upstream to downstream in the direction of feeding the original sheet S, a table elevation sensor 84, a contact sensor 85, an original width sensor 86, a reading inlet sensor 87, a registration sensor 88, and an sheet ejection sensor 89, in this order.

The table elevation sensor 84 detects a top face level of the stack of sheets on the movable document table 51A.

The contact sensor 85 disposed between the sheet feed belt 59 and the feed roller 61 is configured to detect a leading end and a trailing end of the original sheet S.

The original width sensor 86 disposed between the feed roller 61 and the feed roller 62 includes a plurality of light emitting elements arranged along a width direction of the original sheet S and a plurality of light receiving elements disposed opposite the light emitting elements with the document feed path 56 sandwiched therebetween.

The reading inlet sensor 87, the registration sensor 88, and the sheet ejection sensor 89 are used for controlling a feed distance and speed of the original sheet S, detecting jamming of the original sheet S, and the like.

Figure 6:
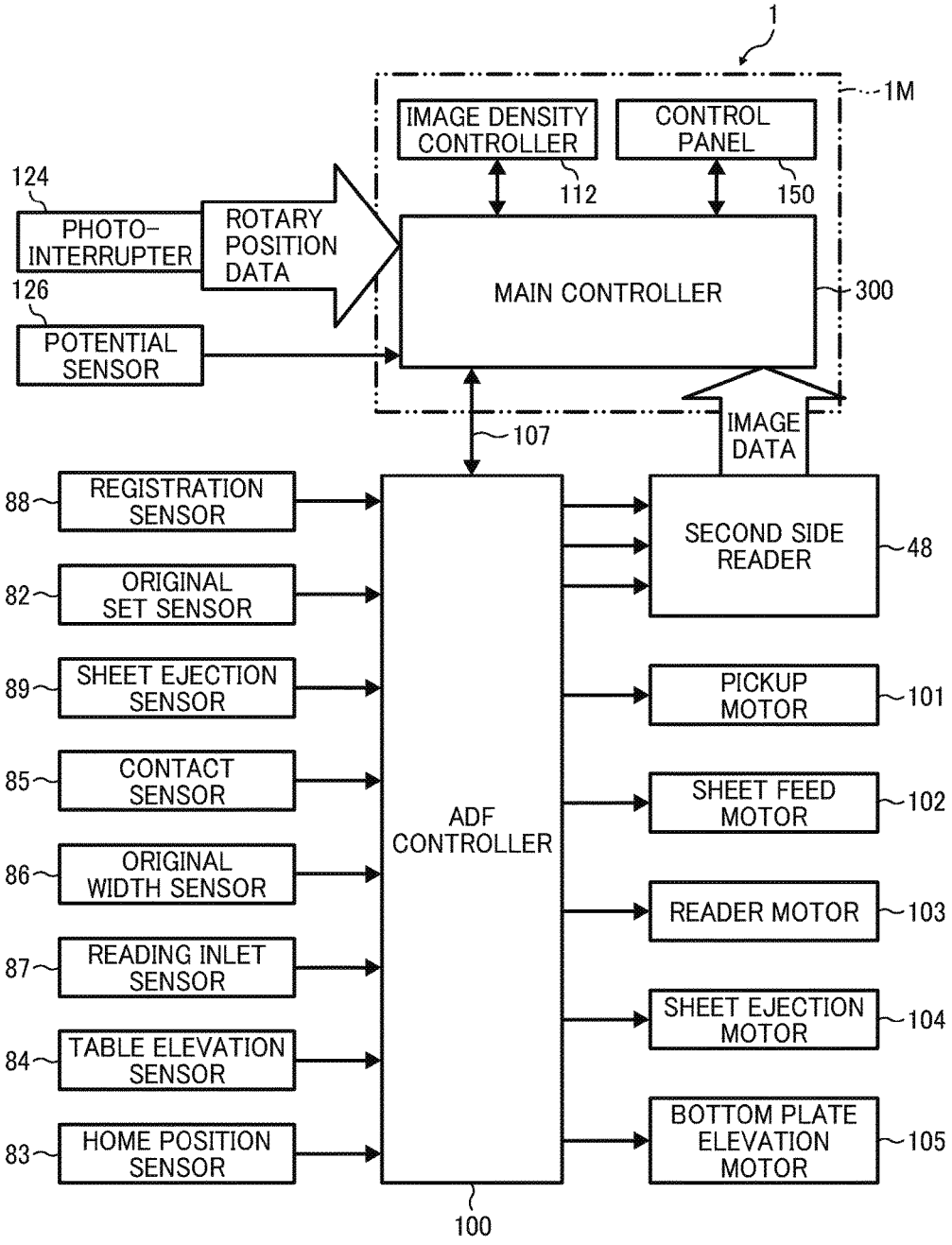
FIG. 6 is a block diagram representing a control system of the image forming apparatus according to the embodiment of the present invention.

As illustrated in FIG. 6, the image forming apparatus 1 includes an ADF controller 100 for the ADF 5, a main controller 300 for controlling the apparatus body, and the control panel 150 attached to the main controller 300.

The ADF controller 100 obtains detected signals from the original set sensor 82, the home position sensor 83, the table elevation sensor 84, the contact sensor 85, the original width sensor 86, the reading inlet sensor 87, the registration sensor 88, and the sheet ejection sensor 89. The ADF controller 100 causes a pickup motor 101, a sheet feed motor 102, and a reader motor 103 to be operated. The pickup motor 101 drives the pickup roller 58, the sheet feed motor 102 drives the sheet feed belt 59 and the feed rollers 61 and 62, and the reader motor 103 drives the feed rollers 63 to 65. Further, the ADF controller 100 causes an ejection motor 104 that drives the ejection roller 67, and a bottom plate elevation motor 105 that elevates and lowers the movable document table 51A, to be operated.

The ADF controller 100 outputs a timing signal to notify a timing at which the leading end of the original sheet S reaches a reading position of the backside scan unit 69, to the second side reader 48. The image data after the above timing is treated as effective data.

The ADF controller 100 and the main controller 300 are connected via an interface 107. The main controller 300 sends an original sheet feed signal and a reading start signal to the ADF controller 100 via the interface 107 when the print button 151 on the control panel 150 is pressed.

Figure 7:
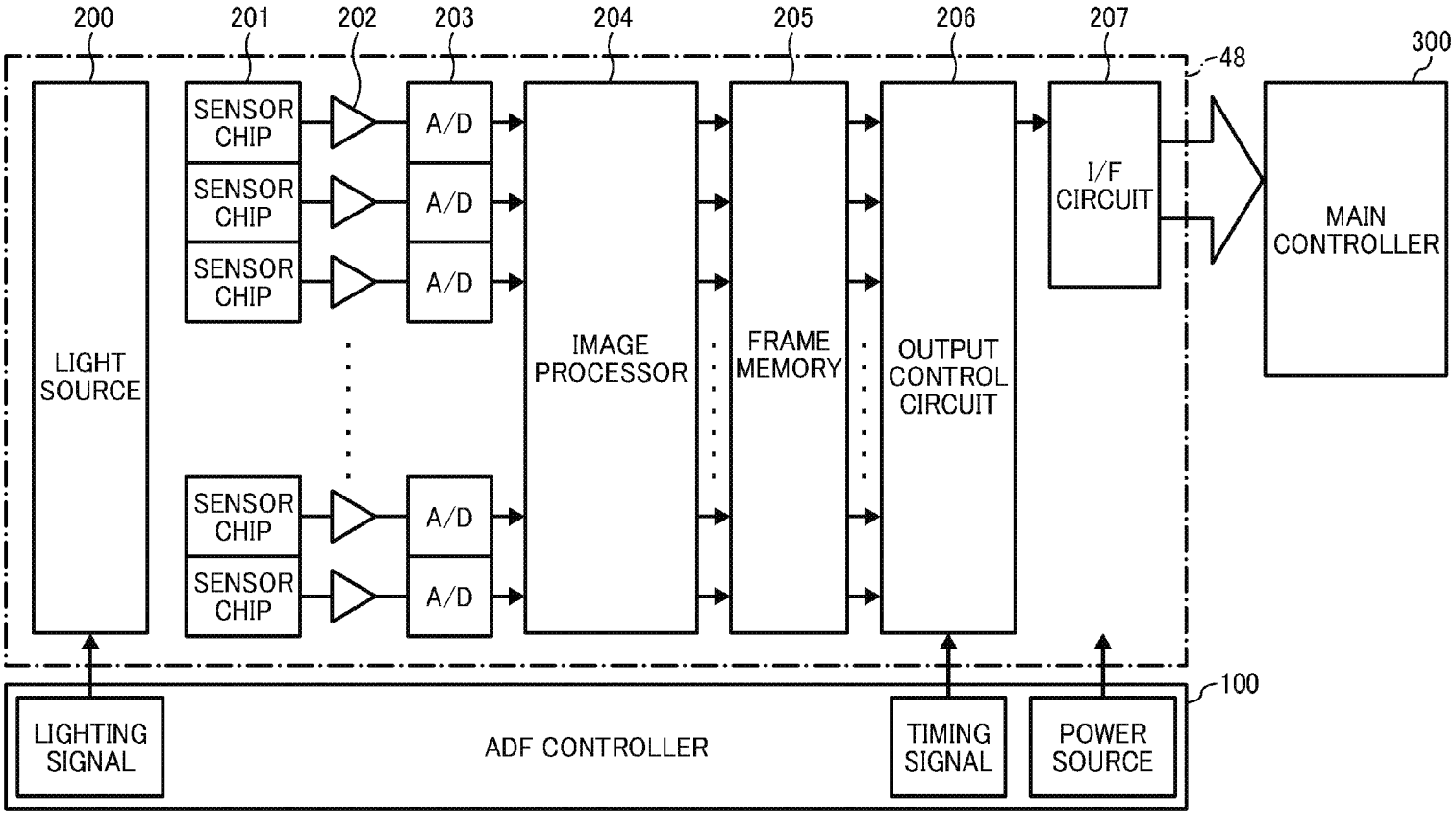
FIG. 7 is a block diagram of a second side reader in the image forming apparatus according to the embodiment of the present invention.

As illustrated in FIG. 7, the second side reader 48 includes a light source 200 that is formed of either an LED array, a fluorescent light, a cold-cathode tube, or the like. The light source 200 irradiates light to the original sheet S based on the lighting signal from the ADF controller 100. In addition, the second side reader 48 obtains a timing signal, from the ADF controller 100, to notify a timing at which the leading end of the original sheet S reaches a reading position of the backside scan unit 69, and receives power from the light source 200.

The second side reader 48 includes a plurality of sensor chips 201 disposed in the main scanning direction, a plurality of OP amplifier circuits 202 connecting to each sensor chip 201, respectively, and a plurality of A/D converters 203 connecting to each OP amplifier circuit 202, respectively. Further, the second side reader 48 includes an image processor 204, a frame memory 205, an output control circuit 206, and an interface (I/F) circuit 207, and the like.

The sensor chips 201 includes a photoelectric conversion element which is a so-called life-size close-up image sensor, and a condenser lens. Light reflected by the second side of the original sheet S is converged to the photoelectric conversion element by the condenser lens of the plurality of sensor chips 201, and is read as image information.

The image information read by each sensor chip 201 is amplified by the OP amplifier circuit 202 and is converted to the digital image information by the A/D converter 203.

The digital image information is input to the image processor 204 and is subjected to a shading correction, and is temporarily stored in the frame memory 205. Further, the digital image information is converted to a data format receivable to the main controller 300 by the output control circuit 206, and is output to the main controller 300 via the I/F circuit 207.

The ADF controller 100 obtains detection data once the original sheet S is placed on the movable document table 51A and transfers the data to the main controller 300. Further, the ADF controller 100 causes the bottom plate elevation motor 105 to be activated and the movable document table 51A to be elevated such that the topmost surface of the stack of original sheets S contacts the pickup roller 58.

The ADF controller 100, upon receipt of the original sheet feed signal, operates the pickup motor 101 to drive the pickup roller 58 that picks up a topmost sheet of the original sheet S on the movable document table 51A.

The ADF controller 100 determines that the original set sensor 82 is not placed on the movable document table 51A when the original set sensor 82 detects a lowest portion on the moving locus of the leading end of the set feeler 57. The ADF controller 100 determines that the original set sensor 82 is placed on the movable document table 51A when the original set sensor 82 does not detect the lowest portion on the moving locus of the leading end of the set feeler 57.

The ADF controller 100 determines that the original sheet S reaches a home position on the movable document table 51A based on the detection information of the home position sensor 83.

When the ADF controller 100 determines that the top face level of the original sheet S detected by the table elevation sensor 84 is lower than a predetermined proper level, the ADF controller 100 operates the bottom plate elevation motor 105 to elevate the movable document table 51A. In addition, when the ADF controller 100 determines that the top face level of the original sheet S detected by the table elevation sensor 84 is elevated and reaches a predetermined proper level, the ADF controller 100 stops the bottom plate elevation motor 105. With this structure, the top face level of the original sheet S is constantly maintained at a position proper to feed the original sheet S.

When the ADF controller 100 determines that all the original sheets S on the movable document table 51A are fed, the ADF controller 100 operates the bottom plate elevation motor 105 to lower the movable document table 51A to the home position. With this structure, another stack of the original sheets *S can* be placed on the movable document table 51A.

The ADF controller 100 determines a length of the original sheet S in the conveyance direction based on the detection timing of the leading end and the trailing end of the original sheet S obtained by the contact sensor 85, and the pulse from the sheet feed motor 102 corresponding to a conveyed distance of the original sheet S.

The ADF controller 100 operates the sheet feed motor 102 until the leading end of the original sheet S separated one by one by an effect between the sheet feed belt 59 and the reverse roller 60 contacts the feed roller 61 being a pullout roller. Specifically, the ADF controller 100 stops the sheet feed motor 102 in a state in which the leading end of the original sheet S presses the feed roller 61 and the original sheet S retains a certain degree of warping. With this structure, the leading end of the original sheet S enters a nip of the feed roller 61, so that alignment of the leading end (that is, skew correction) is performed.

The ADF controller 100 determines a widthwise size of the original sheet S in a direction perpendicular to the sheet feed direction conveyed by the feed roller 61 based on readings from the light receiving element of the original width sensor 86.

Upon detecting the leading end of the original sheet S by the reading inlet sensor 87, the ADF controller 100 decelerates the sheet feed speed to the same speed as the reading feed speed before the leading end of the original sheet S enters the nip of the feed roller 63 disposed near the reading inlet. Further, the ADF controller 100 operates the reader motor 103 to drive the feed rollers 63 to 65.

Upon detecting the leading end of the original sheet S by the registration sensor 88, the ADF controller 100 decelerates the sheet feed speed within a predetermined feed distance, and stops the original sheet S just before the reading position on the first contact glass 45. Then, the ADF controller 100 transfers a signal to represent that the original sheet S temporarily stops at the registration position, to the main controller 300.

Upon receiving a reading start signal from the main controller 300, the ADF controller 100 causes the original sheet S that has stopped at the registration position to be conveyed and accelerated to reach a predetermined feed speed until the leading end of the original sheet S reaches a reading position R.

The ADF controller 100 sends a gate signal representing an effective image area in the sub-scanning direction of the first side to the main controller 300 at a timing when the leading end position of the original sheet S reaches the reading position R. The leading end position is detected by counting the number of pulses from the reader motor 103. The ADF controller 100 continues to transmit the gate signal until the trailing end of the original sheet S passes through the reading position R.

When one side of the original sheet S is to be read, the ADF controller 100 operates the ejection motor 104 to rotate the ejection roller 67 in the sheet ejection direction, upon the sheet ejection sensor 89 detecting the leading end of the original sheet S. Further, the ADF controller 100 obtains the pulse count value from the ejection motor 104 after the sheet ejection sensor 89 has detected the leading end of the original sheet S, and decelerates the feed speed of the original sheet S immediately before the trailing end of the original sheet S passes through the nip of the ejection roller 67, due to the obtained pulse count value.

With this structure, the original sheet S ejected on the document ejection tray 53 is prevented from jumping out of the document ejection tray 53.

When both sides of the original sheet S are to be read, the ADF controller 100 counts the pulse count value of the reader motor 103 since the sheet ejection sensor 89 has detected the leading end of the original sheet S. Further, the ADF controller 100 obtained a timing when the leading end of the original sheet S reaches the reading position of the backside scan unit 69 of the second side reader 48 from the pulse count value of the reader motor 103.

The ADF controller 100 outputs a light source ON signal to light the light source 200 before the original sheet S enters the reading position by the backside scan unit 69 of the second side reader 48. With this structure, the light source 200 lights on, and the light is irradiated to the second side of the original sheet S.

Then, the ADF controller 100 sends a gate signal representing an effective image area of the second side, i.e., the backside of the original sheet S in the sub-scanning direction, to the second side reader 48 until the trailing end of the original sheet S passes through the reading position of the backside scan unit 69 from the above reach timing. In addition, the ADF controller 100 scans the reference white of the shading roller 70 and obtains a shading data in the second side reader 48.

Next, an image density control process of the image forming apparatus 1 will be described.

In the image density control process or in the potential control process, first, a plurality of toner patterns each having a different toner adhesion amount is formed by employing each process cartridge 30Y, 30M, 30C, and 30K in one or more image forming section 3. Then, the potential of the electrostatic latent image in the toner pattern is detected by a potential sensor 126 and the toner adhesion amount of the toner pattern transferred on the intermediate transfer belt 34*b* is detected by a toner adhesion amount sensor 129. At the same time, the toner density inside the developing device 33 in each process cartridge 30Y, 30M, 30C, and 30K in the one or more image forming section 3 is detected by the toner density sensor 33*d*.

An image density controller 112 disposed inside the image forming apparatus 1 calculates each control target value (or image density conditions) related to a charging bias, a developing bias, an exposure light amount (that is, applied voltage or current), and a toner density, based on the above detection results, so that the toner adhesion amount of a predetermined particular image density becomes a predetermined target adhesion amount.

Specifically, the image density controller 112 receives inputs including a detected value of the toner adhesion amount of the toner pattern detected by a toner adhesion amount sensor 129; a detected value of the toner density detected by the toner density sensor 33*d*; a detected value of the surface potential after exposure of the image bearer 32 detected by the potential sensor 126; an outstanding developing device; and a target adhesion amount. The image density controller 112 then outputs, as image density conditions, control target values for each of the charging bias of the charger 13; the developing device of the developing device 33; the exposure amount of the exposure device 31 (i.e., applied voltage or current of the exposure device 31); and the toner density of the developing device 33.

According to the optimal image density conditions or the control target values, applied bias to each device and toner supplies are controlled in the later image forming operation, so that a stable image density can be provided.

Next, referring to FIGS. 8 to 17, the charger 13 and the image bearer 32 of the image forming apparatus 1 will be described in detail.

The charger 13 is configured to employ a charging roller method in which a charging roller 13A rotates in the image forming operation. The charging roller method can be manufactured at a low cost having an uncomplicated structure with fewer corona products compared to a method employing a charger.

Figure 8A:
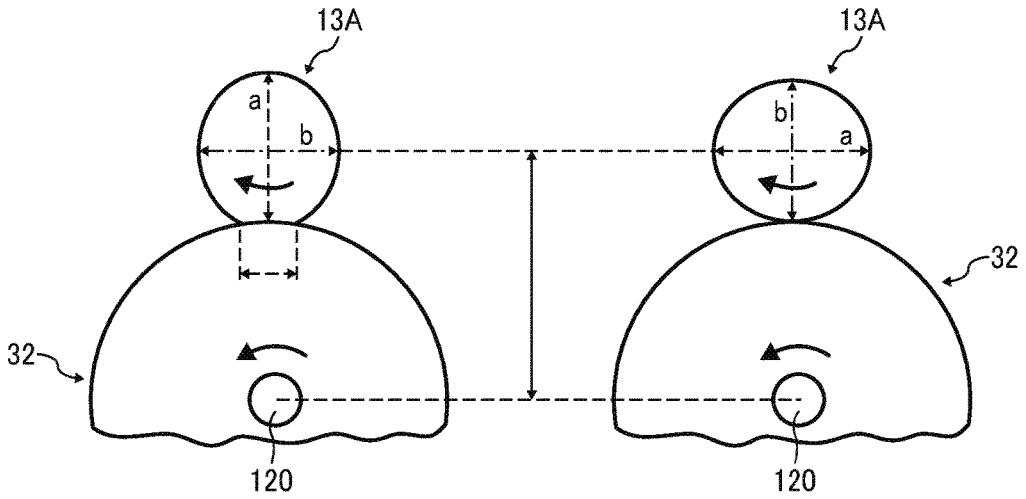
FIGS. 8A and 8B illustrate an aspect in which charge variation occurs due to a charging roller according to the present embodiment.
Figure 8B:
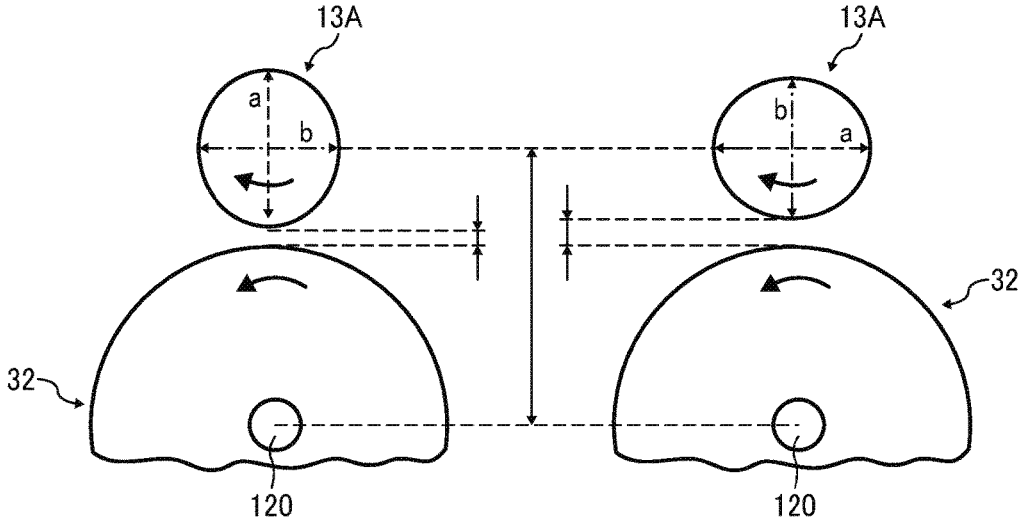
Figure 9:
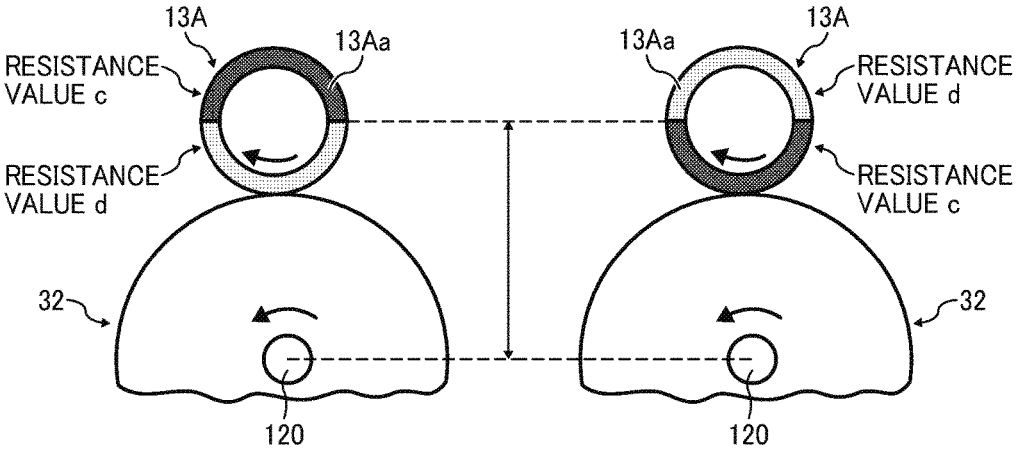
FIG. 9 illustrate an aspect in which charge variation occurs due to the charging roller according to the present embodiment.

Referring to FIGS. 8A, 8B, and 9, the reason why the charge variation occurs to the image bearer 32 and the charging roller 13A will be described.

FIGS. 8A, 8B, and 9 each illustrate a relation of opposed portions between the image bearer 32 and the charging roller 13A, and an exemplary charge variation in the circumferential direction of the image bearer 32 and the charging roller 13A. The charging roller 13A itself includes an uneven surface in the circumferential direction, which causes charge variation on the surface of the image bearer 32.

When the charge variation occurs on the surface of the image bearer 32, variation in the surface potential after exposure having a same cycle as that of the charge variation occurs. The uneven surface of the image bearer 32 is rendered visible as a toner image by the developing device 33, so that the formed toner image includes cyclic density variation. There are two types of variations in the circumferential direction of the charging roller 13A, variation in shape and variation in electrical resistance. The variation in shape and the variation in resistance both results in the charging variation due to the following reasons.

FIG. 8A illustrates one example of variation in shape, in which the charging roller 13A includes a shape of an ellipse, one length is a, the other is b, and a>b.

FIG. 8A is a case that employs a contact charging method. Because the image bearer 32 and the charging roller 13A rotate with each shaft secured, if each circumferential surface is shifting in the circumferential direction, the nip width formed between the surface of the charging roller 13A and the surface of the image bearer 32 varies, so that the charge variation occurs on the surface of the image bearer 32.

FIG. 8B is a case that employs a non-contact charging method. Because the image bearer 32 and the charging roller 13A rotate with each shaft secured, if each circumferential surface is shifting in the circumferential direction, a gap formed between the surface of the charging roller 13A and the surface of the image bearer 32 varies in the circumferential direction. As a result, the charge variation occurs on the surface of the image bearer 32.

In addition, even in the non-contact charging method in which the charging roller 13A includes a member to form a gap, and the member directly contacts the surface of the image bearer 32, the variation in the circumferential direction of the member to form the gap and the variation in the body of the image bearer 32 in combination, causes a gap variation in the circumferential direction, so that the charge variation occurs on the surface of the image bearer 32.

FIG. 9 illustrates an example of resistance variation, and the charging roller 13A includes a conductive member 13Aa, of which the circumference is divided into two semiperimeters each having a different resistance value. One semiperimeter includes resistance c, the other semiperimeter includes resistance d, where c>d.

Because the charging roller 13A rotates in both the contact charging method and the non-contact charging method, if the conductive member 13Aa of the charging roller 13A rotates in the circumferential direction, the resistance of the charging roller 13A changes at a position opposite the image bearer 32. As a result, the charge variation occurs on the surface of the image bearer 32.

The charging roller 13A is formed of the conductive material, so that due to an environmental change such as temperature and humidity, the posture and the resistance of the charging roller 13A in the circumferential direction changes, making the charge variation more remarkable. In particular, in the low-temperature environment, the property changes more drastically. Change in the low-temperature environment will be described in more detail.

Figure 10A:
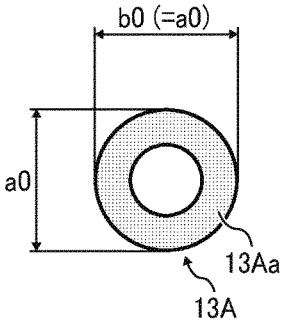
FIGS. 10A and 10B illustrate a change in the shape of the charging roller due to an environmental change.
Figure 10B:
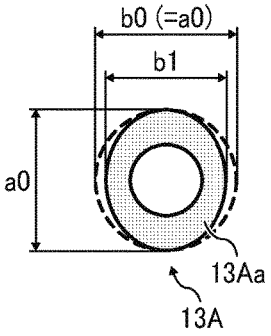

FIGS. 10A and 10B illustrate change in the shape of the charging roller 13A due to the environmental change. For example, in the ambient temperature, variation in the shape in the circumferential direction is small. If the charging roller is proximate to the true circle (that is, the diameter a0 is equal to b0), when the contraction occurs in the conductive member 13Aa in the low-temperature environment, the shape of the circle changes to an ellipse or a shape with a deformation in one direction (that is, the b0 change to b1, which is less than a0). As a result, the charging roller employing the contact charging method shows variation in the circumferential direction at the nip with the image bearer 32, or alternatively, the charging roller employing the non-contact charging method shows variation in the circumferential direction at the gap formed with the image bearer 32, thereby causing the charge variation in the circumferential direction.

Figure 11A:
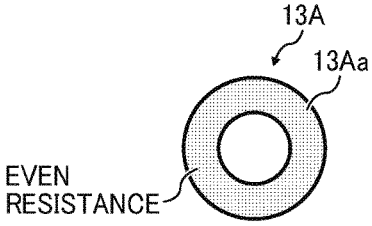
FIGS. 11A and 11B illustrate a change in the resistance of the charging roller due to the environmental change.
Figure 11B:
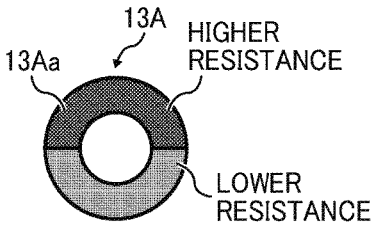

FIGS. 11A and 11B illustrate change in the resistance of the charging roller 13A due to the environmental change. For example, even the charging roller having a substantially uniform quality and constant resistance with less variation in the circumferential direction in the ambient temperature may include a portion with a large resistance and a portion with a small resistance in the circumferential direction due to the difference of the conductive material in the change in the resistance from the normal temperature to the lower temperature. FIG. 11 illustrates an example in which, when the temperature changes from the normal temperature to the lower temperature, an upper half area shows greater resistance than the resistance of the lower half area. Thus, there is a possibility that the charge variation in the circumferential direction occurs due to the variation in the resistance of the charging roller 13A in the circumferential direction.

Due to combined effect of variations in shape and resistance under the low temperature environment, the charge variation occurs remarkably often in the low temperature environment. To prevent the charge variation due to the variation in the circumferential direction, it is necessary to control a shape and resistance with a high definition as a property of the parts of the charging roller 13A in the circumferential direction; however, it is very difficult to control the property to a degree with no effect to the image quality.

Figure 17:
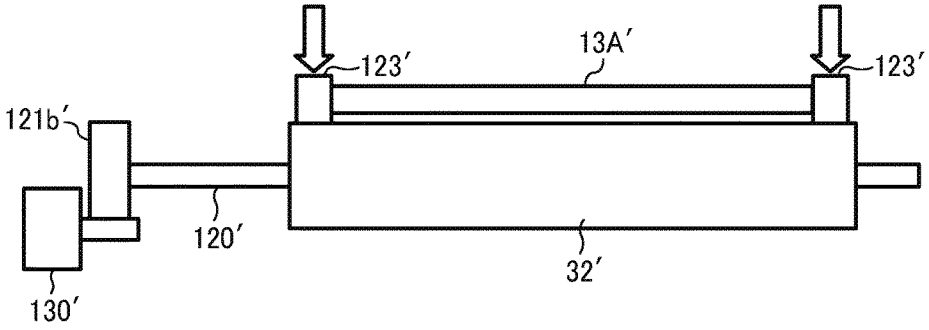
FIG. 17 BACKGROUND ART
FIG. 17 illustrates a drive structure of the charging roller for a conventional image forming apparatus.

To aid in understanding the unique features of the present invention, the drive structure of the conventional image bearer and the charging roller will be described with reference to FIG. 17.

In the illustrated example, the image bearer and the charging roller are configured to have the same linear surface speed. Specifically, as illustrated in FIG. 17, an image bearer 32 is driven by a drive motor 130 via a gear 121*b* of the image bearer drive shaft 120, and a charging roller 13A contacts the image bearer 32 via a gap roller 123 and is driven to rotate. With this structure, however, a defective image may occur due to an adverse effect of charge potential variation due to the charging roller.

Figure 12:
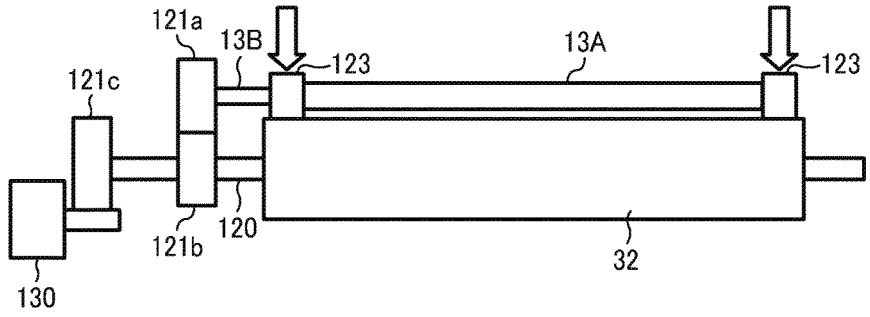
FIG. 12 illustrates a drive structure of the charging roller in the image forming apparatus according to the present embodiment.

According to the image forming apparatus 1 of the present embodiment as illustrated in FIG. 12, a gear 121*a* disposed at one end of a rotary shaft 13B of the charging roller 13A and a gear 121*b* disposed to the image bearer drive shaft 120 are joined and drive the image bearer 32 and the charging roller 13A. The charging roller 13A rotates about the rotary shaft 13B along with the image bearer 32 in the image forming operation.

The image bearer 32 rotates about the image bearer drive shaft 120. In that case, the charging roller 13A is biased in the direction of the image bearer 32 as indicated by an arrow in the figure by a spring and the like, and is driven while keeping a gap defined by a gap roller 123.

A gear 121*c* disposed at one end of the image bearer drive shaft 120, is joined to a drive motor 130, so that the image bearer drive shaft 120 rotates by a driving force of the drive motor 130. A gear ratio between the gear 121*a* and the gear 121*b* is set to a predetermined value, so that the surface linear speed of the charging roller 13A is set to be slower than the surface linear speed of the image bearer 32.

The defective image of the image forming apparatus 1 tends to occur as a gradient of the density variation in the toner image is steeper caused by the charge potential variation in the image bearer 32 after charging by the charging roller 13A. The gradient of the density variation is determined by the charge potential variation and a relation of rotary cycle between the charging roller 13A and the image bearer 32. Accordingly, the gradient of the density variation can be moderated by decreasing the charge potential or by making the rotary cycle of the charging roller 13A longer than the rotary cycle of the image bearer 32.

Figure 13A:
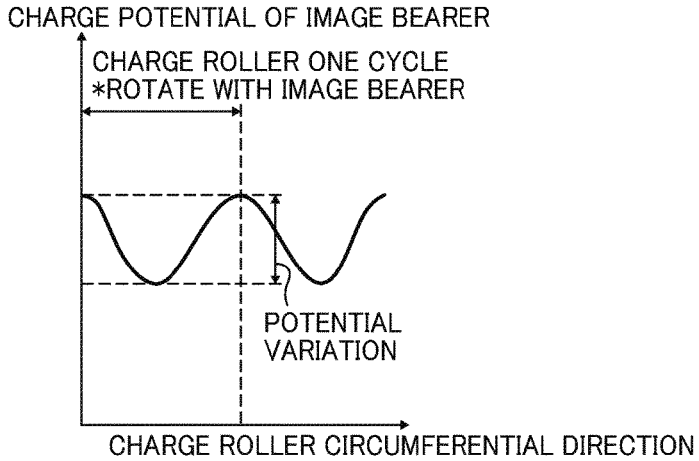
FIGS. 13A and 13B illustrate charge potential variation in an image bearer due to change in the rotary cycle of the charging roller according to the present embodiment.
Figure 13B:
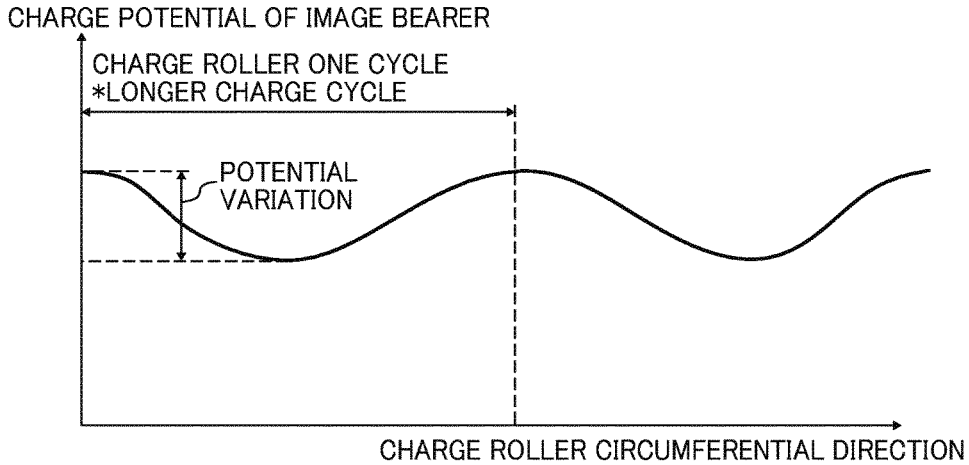

Referring to FIG. 13, the reason why the image quality can be made better even when the charge variation in the charging roller 13A of the image forming apparatus 1 is equivalent.

Figure 14:
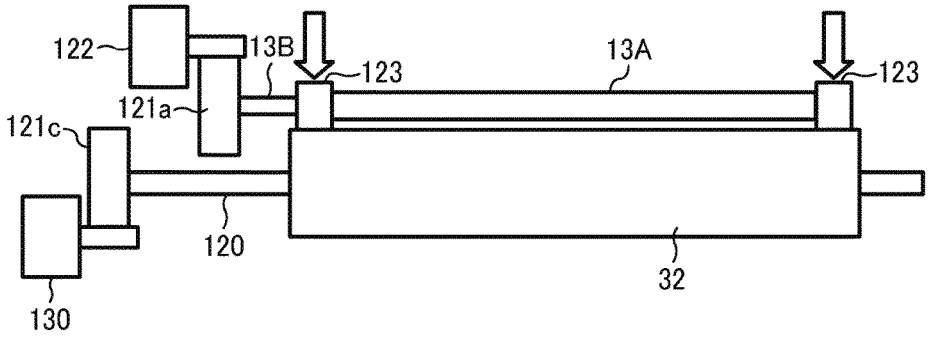
FIG. 14 illustrates a case in which a drive source is provided as a drive structure of the charging roller according to the present embodiment.

FIG. 13 illustrates the charge potential of the image bearer 32 when the charging roller 13A rotates together with the image bearer 32 at the same rotary cycle; and FIG. 14 illustrates the charge potential of the image bearer 32 when the charging roller 13A rotates with a longer rotary cycle. Because the charging roller 13A is the same, magnitude of the charge potential variation is the same; however, because the rotary cycle of the charging roller 13A is different, the gradient of the charge potential variation becomes moderate. This gradient reflects the change of the density, so that the image quality becomes better if the gradient becomes moderate.

As described above, the image forming apparatus 1 according to the present embodiment is configured such that the surface linear speed of the charging roller 13A is set to be slower than the surface linear speed of the image bearer 32. As a result, the gradient of the density change of the toner image becomes moderate, thereby preventing the defective image from occurring. In addition, there is no need of providing an independent drive motor for rotating the charging roller 13A and a device for detecting a gap between the image bearer 32 and the charging roller 13A. As a result, with a not-complicated structure, a defective image is prevented from occurring.

In addition, in the above embodiment, the image bearer 32 is used as a drive source for the charging roller 13A. Alternatively, as illustrated in FIG. 14, a drive motor 122 can be employed separately so that the rotation speed of the charging roller 13A can be variable and the surface linear speed of the charging roller 13A is changeable arbitrarily.

With this structure, the image forming apparatus 1 according to the present embodiment is configured such that the rotary cycle of the charging roller 13A can be set to longer than the rotary cycle of the image bearer 32. As a result, the gradient of the density change of the toner image becomes moderate, and the defective image can be prevented from occurring.

As a means to change the rotation speed of the charging roller, a separate drive source such as the drive motor 122 as illustrated in FIG. 14 need be used to make the rotation speed of the charging rotation speed variable. However, when the maximum value of the charge potential variation and its effect to the image formation is grasped and an appropriate rotary cycle can be calculated, the charging roller can be supplied with power from other drive source such as the image bearer 32.

In the first embodiment, a method for changing the rotary cycle of the charging roller and moderating the charge potential variation has been illustrated. In the above method, however, the gradient of the charge potential variation is moderated, but the variation itself of the charge potential is not suppressed.

To cope with the problem, a structure to drive to rotate the charging roller such that the surface of the charging roller rotates with a predetermined speed difference relative to the surface of the image bearer while rotating, has been disclosed. However, what the relation between the rotary cycle of the charging roller and the rotary cycle of the image bearer should be is considered, to suppress the charge potential variation. The image forming apparatus according to a second embodiment addresses the above problem and aims to obtain a better image by changing the rotary cycle of the charging roller and suppressing the charge potential variation.

Second Embodiment

Hereinafter, an image forming apparatus according to a second embodiment of the present invention will be described.

The image forming apparatus according to the second embodiment employs a rotary position sensor which is different from the one in the first embodiment; however, the other structural elements are the same. Accordingly, the same reference numeral in the first embodiment as illustrated in FIGS. 1 to 14 is applied to the same constituent part, and different points alone will be described in particular.

Figure 15:
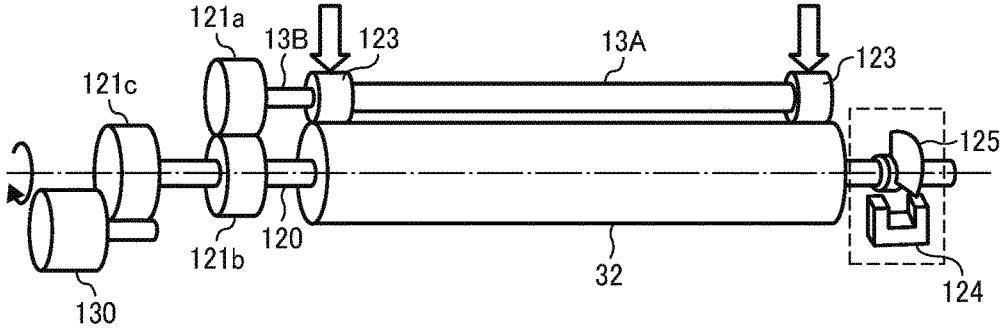
FIG. 15 illustrates a drive structure of the charging roller according to a second embodiment of the present invention.

FIG. 15 illustrates a drive structure of the image bearer 32 and the charging roller 13A including a rotary position sensor in the image forming apparatus 1 according to the second embodiment of the present invention.

The image bearer 32 is connected with the charging roller 13A via a gear 121*a* and a gear 121*b*. The gear ratio between the gear 121*a* and the gear 121*b* is set to an integer, so that the rotary cycle of the charging roller 13A falls on an integral multiple of the rotary cycle of the image bearer 32. By setting the rotary cycle of the charging roller 13A as an integral multiple of the rotary cycle of the image bearer 32, correction of the charge potential variation occurring due to the rotary cycle of the charging roller 13A can be possible by a bias control of the image bearer 32, which will be described later.

A light shield 125 and a photo interrupter 124 are mounted on the image bearer drive shaft 120 of the image bearer 32. The light shield 125 and the photo interrupter 124 form the rotary position detector according to this embodiment of the present disclosure.

The light shield 125 cyclically rotates together with the image bearer drive shaft 120 and blocks light that passes through a predetermined detection area. The photo interrupter 124 detects the light shield 125 when the image bearer 32 positions at a predetermined rotary position according to a rotation of the image bearer 32. With this structure, the photo interrupter 124 detects a rotary position of the image bearer 32.

The potential sensor 126 is disposed near the surface of the image bearer 32 and detects a surface potential of the image bearer 32.

Next, a bias control of the image bearer 32 will be described.

The main controller 300 is configured to control a charge condition of the charging roller 13A based on a rotary position of the image bearer 32 detected by the photo interrupter 124 and the charge potential distribution of the surface potential of at least one circumferential length of the image bearer 32 detected by the potential sensor 126.

More specifically, the main controller 300 divides the charge potential variation detected by the potential sensor 126 by the rotary cycle of the image bearer 32, and changes the charging bias cyclically with a signal from the photo interrupter 124 set as a trigger, so that the electric field variation due to rotary oscillation is cancelled and the detected charge potential variation is suppressed. As a result, the charge potential variation due to the image bearer 32 can be corrected.

As described above, the image forming apparatus 1 according to the second embodiment is configured such that the rotary cycle of the charging roller 13A is an integral multiple of the rotary cycle of the image bearer 32, and that the variation in the charge potential due to bias control of the image bearer 32 can be suppressed, thereby obtaining a quality image.

Figure 16:
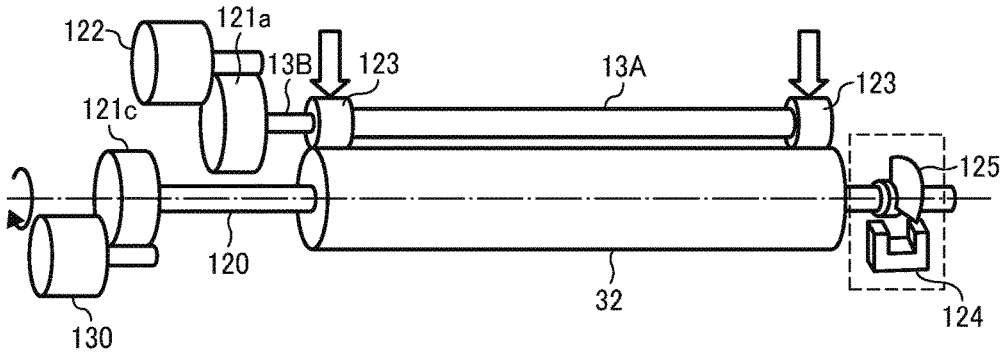
FIG. 16 illustrates a case in which a drive source is provided as a drive structure of the charging roller according to the present embodiment.

In addition, in the above embodiment, the image bearer 32 is used as a drive source for the charging roller 13A. Alternatively, as illustrated in FIG. 16, a drive motor 122 can be employed separately so that the rotation speed of the charging roller 13A can be variable and the surface linear speed of the charging roller 13A is changeable arbitrarily.

With this structure, the image forming apparatus 1 according to the present embodiment is configured such that the rotary cycle of the charging roller 13A can be changed to an arbitrary scale of integral multiple of the rotary cycle of the image bearer 32. As a result, the charging roller 13A can be driven optimally in accordance with the environment. For example, in a cold environment where degradation of the charge potential variation in the charging roller is remarkable, the scale of the integral multiple is raised and the charging roller 13A is driven slowly.

According to the present invention, a following optimal effect can be obtained with a not-complicated structure. That is, due to the variation in the shape and resistance of the charging roller, density variation occurs to the charging roller in the rotary cycle, resulting in the defective image of the formed image in the image forming apparatus. Such a defective image can be suppressed with a not-complicated structure, which is applicable to the image forming apparatuses in general.

Third Embodiment

A type of image forming apparatus is configured such that a gap is provided between the circumferential surface of the image bearer and the charging roller. In the present image forming apparatus, the linear speed of the charging roller is increased during image formation, an area in the circumferential direction of the charging roller having a gap more than the predetermined allowance passes the charging area in a shorter time period. Due to the above structure, the charge variation in the rotary cycle of the charging roller due to the gap variation between the charging roller and the image bearer can be reduced.

However, the above exemplary image forming apparatus has such a problem that a load to the drive motor to rotationally drive the charging roller increases due to increase in the rotational speed of the charging roller.

Figure 18:
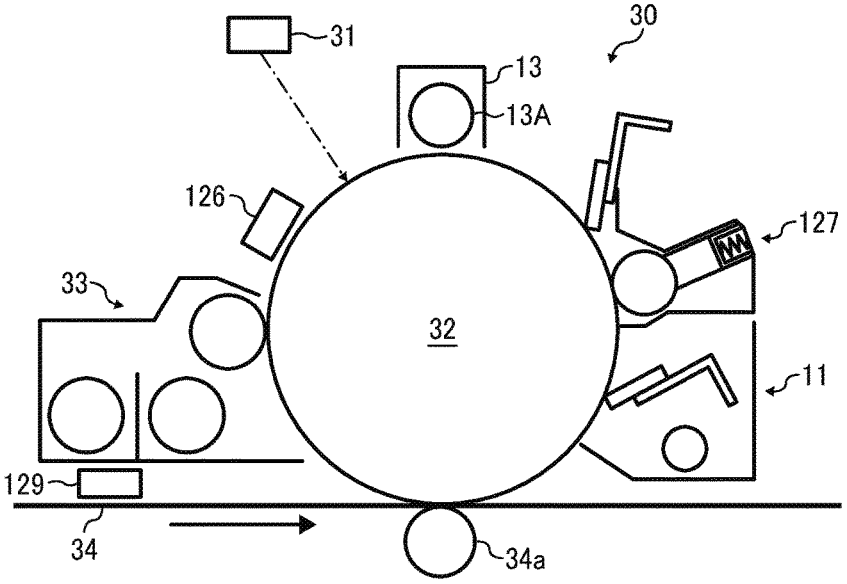
FIG. 18 illustrates a schematic structure of the image forming unit.

FIG. 18 illustrates a schematic structure of the image forming unit 30.

As illustrated in FIG. 3, the image forming apparatus 1 includes a process cartridge 30 for one color or a plurality of cartridges for each of four colors. Each process cartridge 30 drives to rotate while contacting an intermediate transfer belt 34*b*. Herein, the image forming apparatus having four process cartridges 30 will be described.

Each process cartridge 30 includes an image bearer 32, and following parts each of which is detachably disposed around the image bearer 32. That is, the charger 13 includes a charging roller 13A to charge a surface of the image bearer 32, a developing device 33 to render a latent image formed on the surface of the image bearer 32 visible with each color of toner, a drum cleaner 11 to collect residual toner remaining on the surface of the image bearer 32 after transferring the toner image, and a lubricant applicator 127 to coat the lubricant to protect the surface of the image bearer 32. Each process cartridge 30 is attachable to and detachable from a body of the image forming apparatus.

In the process cartridge 30, an exposure device 31 disposed on the body of the image forming apparatus exposes the surface of the image bearer 32 charged by the charging roller 13A with laser beams, to thereby form an electrostatic latent image. The electrostatic latent image is rendered visible as a toner image by being developed by the developing device 33 to which a predetermined amount of toner is replenished from each toner bottle including toner of each color of yellow, magenta, cyan, or black. The developed visible toner image is transferred onto the intermediate transfer belt 34*b* by the primary transfer roller 34*a*. The residual toner remaining on the image bearer 32 is collected by the drum cleaner 11, and is conveyed through a conveyance path inside the drum cleaner 11, to a toner recycling bin disposed in the apparatus body. After collection of the residual toner by the drum cleaner 11, the lubricant applicator 127 applies a lubricant on the surface of the image bearer 32, to thus form a protective layer thereon.

Yellow, magenta, cyan, and black toner is sequentially transferred from the image bearer 32 of each process cartridge 30 on the intermediate transfer belt 34*b*. In this case, each image forming operation of each color is shifted in time from upstream to downstream in the rotation direction so that each toner image is superimposed on the same position on the intermediate transfer belt 34*b*.

The toner image formed on the intermediate transfer belt 34*b* is transferred to the secondary transfer section 35 and is secondarily transferred to the transfer sheet P, being a recording medium conveyed at a proper timing from the sheet feed device. The residual toner remaining on the intermediate transfer belt 34*b* after the secondary transfer, is collected by a cleaner 128, and is conveyed to a toner recycling bin disposed in the apparatus body 1M, in the same manner as the drum cleaner 11 of the process cartridge 30. The transfer sheet P on which the toner image is transferred is conveyed to the fixing device 36 where the toner image is fixed onto the transfer sheet P with heat, and is ejected by a sheet ejection roller 67.

The image forming apparatus 1 according to the third embodiment of the present invention conducts image density control as follows. In the image density control or in potential control, first, a plurality of toner patterns each having a different toner adhesion amount is formed by employing one or more process cartridges 30. Then, the potential of the electrostatic latent image in the toner pattern is detected by a potential sensor 126 and the toner adhesion amount of the toner pattern transferred on the intermediate transfer belt 34*b* is detected by a toner adhesion amount sensor 129 as illustrated in FIG. 18. At the same time, the toner density inside the developing device 33 in the one or more process cartridges 30 is detected by the toner density sensor 33*d* (see FIGS. 1 to 3).

An image density controller 112 disposed inside the image forming apparatus 1 calculates each control target value (or image density conditions) related to a charging bias, a developing bias, an exposure light amount (that is, applied voltage or current), and a toner density, based on the above detection results, so that the toner adhesion amount of a predetermined particular image density becomes a predetermined target adhesion amount. Specifically, the image density controller 112 receives inputs including a detected value of the toner adhesion amount of the toner pattern detected by a toner adhesion amount sensor 129; a detected value of the toner density detected by the toner density sensor 33*d*; a detected value of the surface potential after exposure of the image bearer 32 detected by the potential sensor 126; an outstanding developing device; and a target adhesion amount, and outputs, as image density conditions, each control target value of the charging bias of the charging roller 13A; the developing device of the developing device 33; the exposure amount of the exposure device 31 (i.e., applied voltage of current of the exposure device 31); and the toner density of the developing device 33. According to the optimal image density conditions or the control target values, applied bias to each device and toner supplies are controlled in the later image forming operation, so that a stable image density can be provided.

In addition, the linear speed of the charging roller is controlled to be marched with the image bearer of the charging roller, so that the difference in the diameter of the charging roller relative to the image bearer produces a difference in the rotary cycle.

A main controller 300 as illustrated in FIG. 1 controls on each section and each device disposed in each section, disposed inside the body of the image forming apparatus, requiring controlled operation. The main controller 300 will be described referring to FIG. 19.

Figure 19:
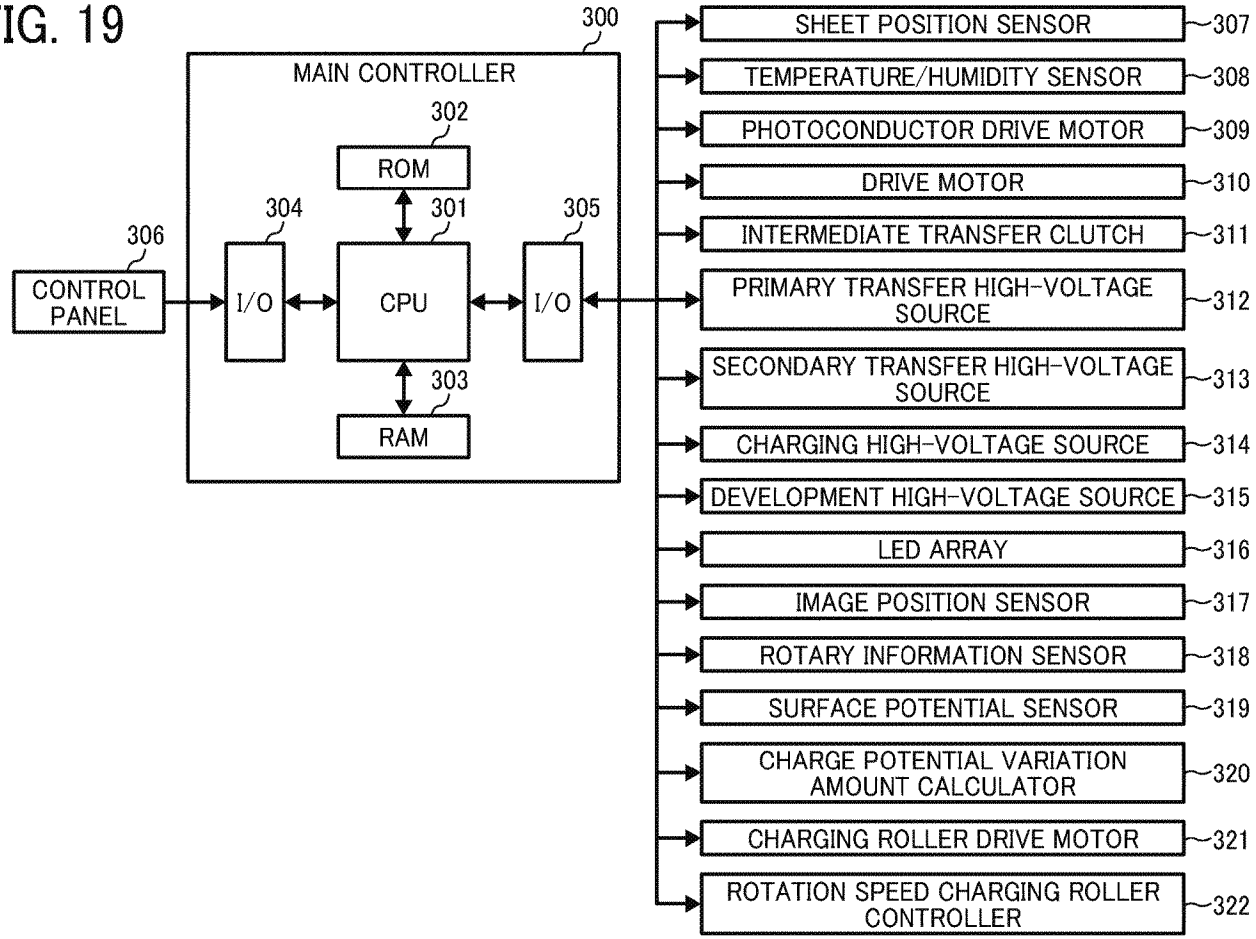
FIG. 19 illustrates a general configuration of a control system of the image forming apparatus.

FIG. 19 shows a general configuration of the image forming apparatus 1. As illustrated in FIG. 19, the main controller 300 includes a central processing unit (CPU) 301, memories such as a ROM 302 and a RAM 303, I/O ports 304 and 305 for inputs and outputs, and the like. The I/O port 304 is connected to a control panel 306. The I/O port 305 is connected to a sheet position sensor 307, a temperature and humidity sensor 308, a photoconductor drive motor 309, a belt drive motor 310, an intermediate transfer attach/detach clutch 311, a primary transfer high voltage power source 312, a secondary transfer high-voltage power source 313, a charging high-voltage power source 314, a development high-voltage power source 315, an LED array 316, an image position sensor 317, a rotary information sensor 318, a surface potential sensor 319, a charge potential variation amount calculator 320, a charging roller drive motor 321, a rotational speed charging roller controller 322, and the like.

Next, referring to FIGS. 20 to 26, the charging roller 13A and the image bearer 32 of the image forming apparatus 1 will be described in detail.

Figure 20A:
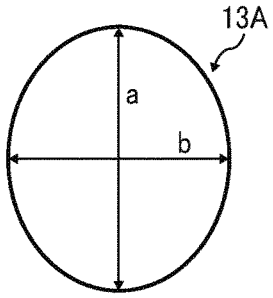
FIGS. 20A to 20C each are views illustrating charge variation occurring in the circumferential direction of the charging roller due to variation in the shape of the charging roller.
Figure 20B:
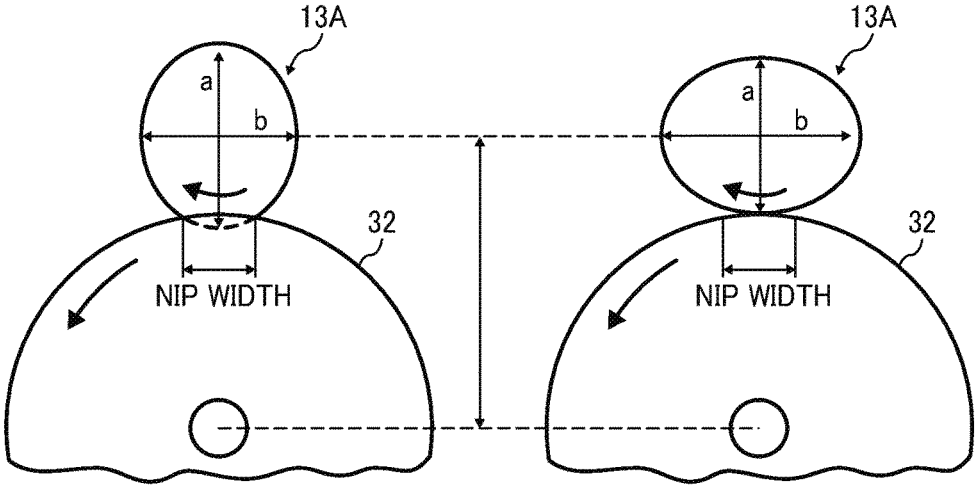
Figure 20C:
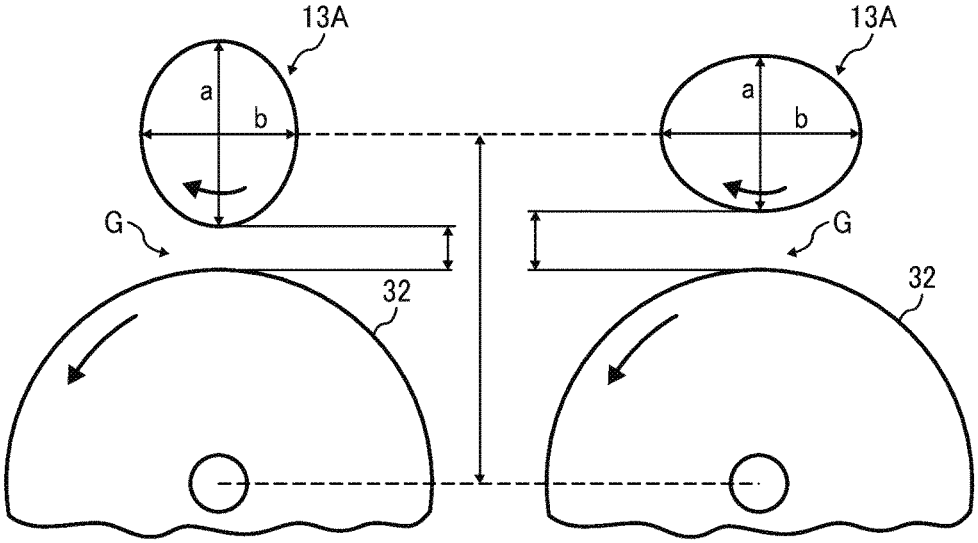
Figure 21A:
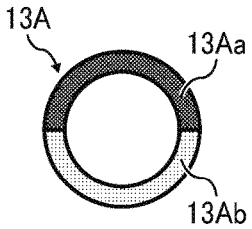
FIGS. 21A to 21B each are views illustrating charge variation occurring in the circumferential direction of the charging roller due to variation in the resistance of the charging roller in another manner.
Figure 21B:
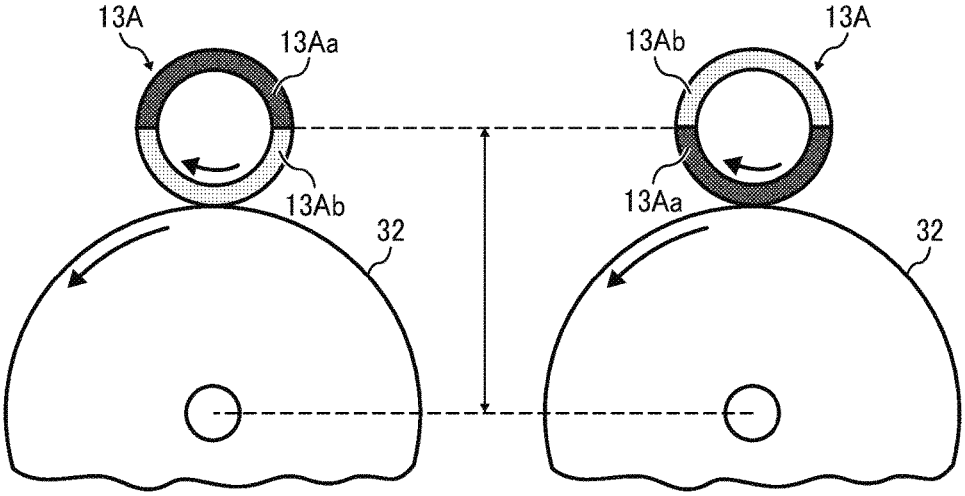

FIGS. 20A to 20C each are views illustrating charge variation occurring in the circumferential direction of the charging roller. FIGS. 21A to 21B each are views illustrating charge variation occurring in the circumferential direction of the charging roller in another manner.

The charger 13 is configured to employ a charging roller method in which a charging roller 13A rotates in the image forming operation. The charging roller method can be manufactured at a low cost having a not-complicated structure with less corona products compared to a method employing a charger.

Referring to FIGS. 20A to 20C and 21A to 21B, the reason why the charge variation occurs to the image bearer 32 and the charging roller 13A will be described.

FIGS. 20A to 20C, 21A, and 21B each illustrate a relation of opposed portions between the image bearer 32 and the charging roller 13A, and an exemplary charge variation in the circumferential direction of the image bearer 32 and the charging roller 13A. The charging roller 13A itself includes an uneven surface in the circumferential direction, which causes charge variation on the surface of the image bearer 32. There are two types of variations in the circumferential direction of the charging roller 13A, one is variation in shape, and the other is variation in resistance.

When the charge variation occurs on the surface of the image bearer 32, variation in the surface potential after exposure having a same cycle as that of the charge variation occurs. The uneven surface of the image bearer 32 is rendered visible as a toner image by the developing device 33, so that the formed toner image includes cyclic density variation.

The variation in shape and the variation in resistance both results in the charging variation in the circumferential direction due to the following reasons.

FIG. 20A illustrates one example of variation in shape, in which the charging roller 13A includes a shape of an ellipse, one length is a, the other is b, and a>b.

FIG. 20B is a case that employs a contact charging method. Because the image bearer 32 and the charging roller 13A rotate with each shaft fixed, a length between two shafts is constant. With this structure, if each circumferential surface is shifting in the circumferential direction, the nip width formed between the surface of the charging roller 13A and the surface of the image bearer 32 varies. As a result, a surface potential of the image bearer 32 changes due to contact electrification, so that the charge variation occurs on the surface of the image bearer 32.

FIG. 20C is a case that employs a non-contact charging method. Because the image bearer 32 and the charging roller 13A rotate with each shaft fixed, a length between two shafts is constant. Accordingly, if each outer circumferential surface of each of the image bearer 32 and the charging roller 13A rotates in the circumferential direction, a gap G formed between the surface of the image bearer 32 and the surface of the charging roller 13A varies. As a result, a surface potential of the image bearer 32 changes due to electrical discharge, and the charge variation occurs on the surface of the image bearer 32.

In addition, even in the non-contact charging method in which the charging roller 13A includes a member to form a gap G, and the member directly contacts the surface of the image bearer 32, the variation in the circumferential direction of the member to form the gap (i.e., a gap roller) and the variation in the body of the image bearer 32 in combination, causes a gap variation in the circumferential direction, so that the charge variation occurs on the surface of the image bearer 32 in the circumferential direction.

FIGS. 21A to 21B illustrate an example of variation in the resistance of the charging roller. As illustrated in FIG. 21A, the charging roller 13A includes a first conductive member 13Aa and a second conductive member 13Ab each having different resistance. (The first conductive member 13Aa as one semiperimeter has resistance c, and the second conductive member 13Ab as the other semiperimeter has resistance d, and c>d.)

Figure 22A:
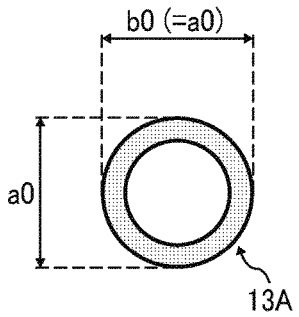
FIGS. 22A and 22B illustrate change in the shape of the charging roller due to the environmental change.
Figure 22B:
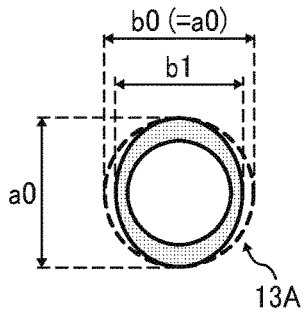

As illustrated in FIG. 22B, because the charging roller 13A rotates in both the contact charging method and the non-contact charging method, if the conductive member 13Aa of the charging roller 13A rotates in the circumferential direction, the resistance of the charging roller 13A changes at a position opposite the image bearer 32. As a result, the charge variation occurs on the surface of the image bearer 32.

The charging roller 13A is formed of the conductive material, so that due to an environmental change such as temperature and humidity, the posture of the charging roller 13A in the circumferential direction changes, making the charge variation more remarkable. In particular, in the low-temperature environment, the property changes more drastically. Change in the low-temperature environment will be described in more detail.

FIGS. 22A and 22B illustrate change in the shape of the charging roller 13A due to the environmental change. For example, in the ambient temperature, variation in the shape in the circumferential direction is small. If the charging roller is proximate to the true circle, when the contraction occurs in the conductive member 13Aa in the low-temperature environment, the shape of the circle changes to an ellipse or a shape with a deformation in one direction. As a result, the charging roller employing the contact charging method shows variation in the circumferential direction at the nip with the image bearer 32, or alternatively, the charging roller employing the non-contact charging method shows variation in the circumferential direction at the gap formed with the image bearer 32, thereby causing the charge variation in the circumferential direction.

Figure 22C:
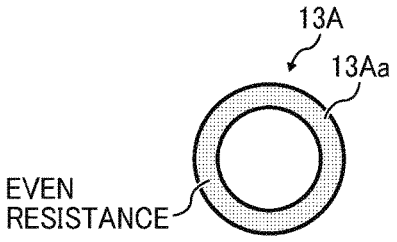
FIGS. 22C and 22D illustrate change in the resistance of the charging roller due to the environmental change.
Figure 22D:
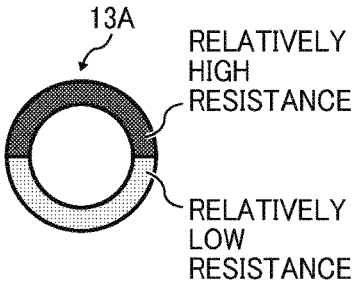

FIG. 22C illustrates change in the resistance of the charging roller 13A due to the environmental change. FIG. 22D illustrates an example in which, when the temperature changes from the normal temperature to the lower temperature, an upper half area of the charging roller shows greater resistance than the resistance of the lower half area. For example, even though the charging roller having a substantially uniform quality and constant resistance with less variation in the circumferential direction in the ambient temperature may include a portion with a large resistance and a portion with a small resistance in the circumferential direction due to the difference of the conductive material in the change in the resistance from the normal temperature to the lower temperature. Thus, there is a possibility that the charge variation in the circumferential direction occurs due to the variation in the resistance of the charging roller 13A in the circumferential direction.

Due to combined effect of variations in shape and resistance under the low temperature environment, the charge variation occurs remarkably often in the low temperature environment. To prevent the charge variation due to the variation in the circumferential direction, it is necessary to control a shape and resistance with a high definition as a property of the parts of the charging roller 13A in the circumferential direction; however, it is very difficult to control the property to a degree with no effect to the image quality.

Figure 23:
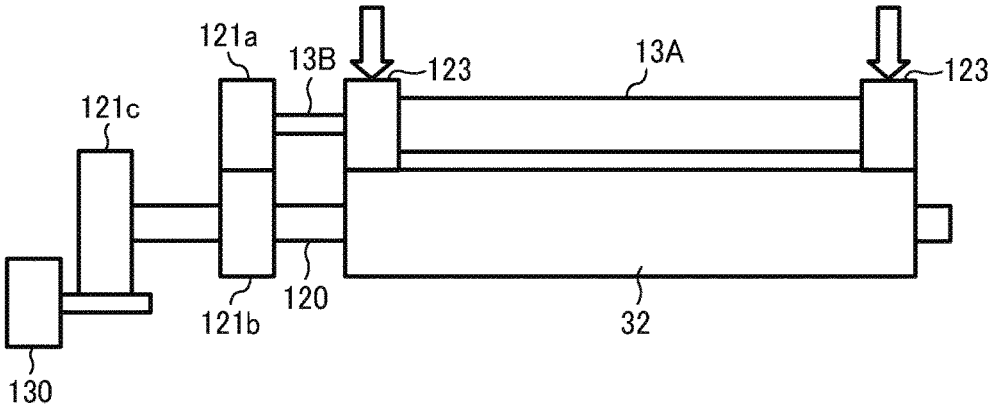
FIG. 23 illustrates a drive structure according to a gear connection between the charging roller and the image bearer in the non-contact charging method.

As to a drive structure of the image bearer 32 and the charging roller 13A of the image forming apparatus 1 of the present embodiment as illustrated in FIG. 23, a gear 121*a* disposed at one end of a rotary shaft 13B of the charging roller 13A connects a gear 121*b* disposed to the image bearer drive shaft 120 and rotates. The charging roller 13A rotates about the rotary shaft 13B along with the image bearer 32 in the image forming operation.

The image bearer 32 rotates pivotally about the image bearer drive shaft 120. In that case, the charging roller 13A is biased in the direction of the image bearer 32 as indicated by an arrow in the figure by a spring and the like, and is driven while keeping a gap defined by a gap roller 123.

A gear 121*c* disposed at one end of the image bearer drive shaft 120, is joined to a drive motor 130, so that the image bearer drive shaft 120 rotates by a driving force of the drive motor 130. A gear ratio between the gear 121*a* and the gear 121*b* is set to a predetermined value, so that the surface linear speed of the charging roller 13A is set to slower than the surface linear speed of the image bearer 32.

The defective image of the image forming apparatus 1 tends to occur as the density variation slope of the toner image is steeper charge potential. The gradient of the density variation is determined by the charge potential variation and a relation of rotary cycle between the charging roller 13A and the image bearer 32. Accordingly, the gradient of the density variation can be moderated by decreasing the charge potential or by making the rotary cycle of the charging roller 13A longer than the rotary cycle of the image bearer 32.

Figure 24:
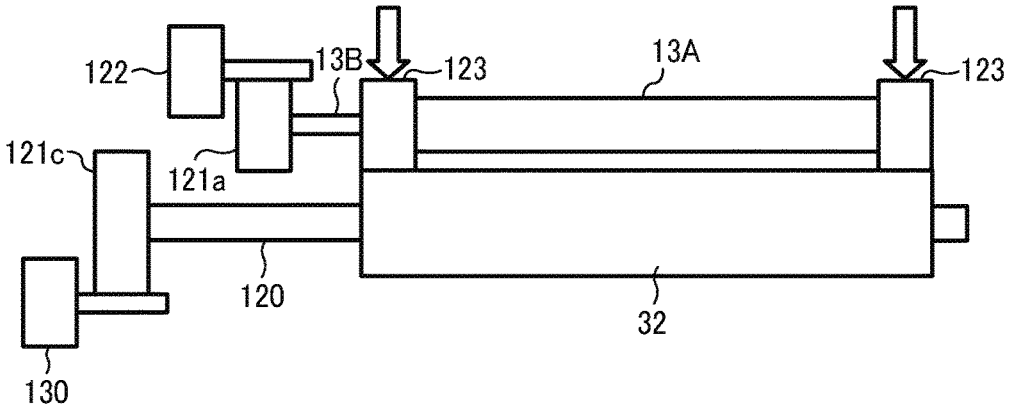
FIG. 24 illustrates a drive structure due to independent drive of the image bearer and the charging roller in the non-contact charging method.

As a means to change the rotation speed of the charging roller, a separate drive source such as the drive motor 122 as illustrated in FIG. 24 need be used to make the rotation speed of the charging rotation speed variable. However, when the maximum value of the charge potential variation and its effect to the image formation is grasped and an appropriate rotary cycle can be calculated, the charging roller can be supplied with power from other drive source such as the image bearer 32.

As described above, the image forming apparatus 1 according to the present embodiment is configured such that the surface linear speed of the charging roller 13A is set to be slower than the surface linear speed of the image bearer 32. As a result, the gradient of the density change of the toner image becomes moderate, thereby preventing the defective image from occurring. Then, the circumferential surface of the gap roller 123 and the circumferential surface of the image bearer 32 contacting the surface of the gap roller 123 become worn due to abrasion, thereby shortening each lifetime. Then, in the following fifth embodiment, the rotational speed of the charging roller is controlled such that the linear speed of the charging roller 13A is decreased to slower than the linear speed of the image bearer 32 only when the charge variation occurs, and the linear speed of the charging roller 13A is brought to the same as that of the image bearer 32 when no charge variation occurs. The lower speed or the first rotational speed and the same speed or the second rotational speed are switchable. Hereinafter, the fifth embodiment will be described in detail.

The image forming apparatus 1 according to the present embodiment includes a potential sensor 126 disposed downstream of the charging roller 13A than the exposure portion in the rotation direction of the image bearer and before the developing device 33. The potential sensor 126 is used for image density control and is used for detecting the charge potential variation in the present embodiment.

The potential sensor 126 detects chronological change in the charge potential of the image bearer and the chronological signal is stored in the signal memory. From the chronological signal stored in the signal memory, variation component of the signal in the rotary cycle of the charging roller is extracted. When the variation component of signal in the rotary cycle of the charging roller, that is, the charge variation in the rotary cycle of the charging roller exceeds a predetermined threshold, a rotation speed of the charging roller is decreased, so that the charge variation in the rotary cycle of the charging roller can be suppressed. With this structure, the density change of the toner image becomes moderate, and the defective image can be suppressed. Further, because the rotational speed of the charging roller becomes low, the load applied to the drive motor to rotate the charging roller can be reduced. On the other hand, when the charge variation in the rotary cycle of the charging roller does not exceed the threshold, the rotation speed of the charging roller is not decreased and the charging roller is rotated at the substantially same speed as the of the image bearer. With this structure, the load to the drive motor is further lightened.

As illustrated in FIG. 1, when the image forming apparatus 1 includes four process cartridges, as to only the process cartridge in which the amount of variation in the charge potential in the rotary cycle of the charging roller exceeds the threshold, the linear speed of the charging roller is decreased to low relative to the image bearer. With this structure, because the rotation speed of the charging roller included in only the process cartridge of which the charge variation in the charging roller in the circumferential direction is detected, is changed, the abrasion between the charging roller and the image bearer can be minimized. The charging roller drive motor is disposed to the apparatus body of the image forming apparatus other than the process cartridge. Accordingly, because the charging roller drive motor is disposed to the apparatus body of the image forming apparatus, the replacement of the charging roller drive motor is not conducted together with the process cartridge at the same time.

Figure 25:
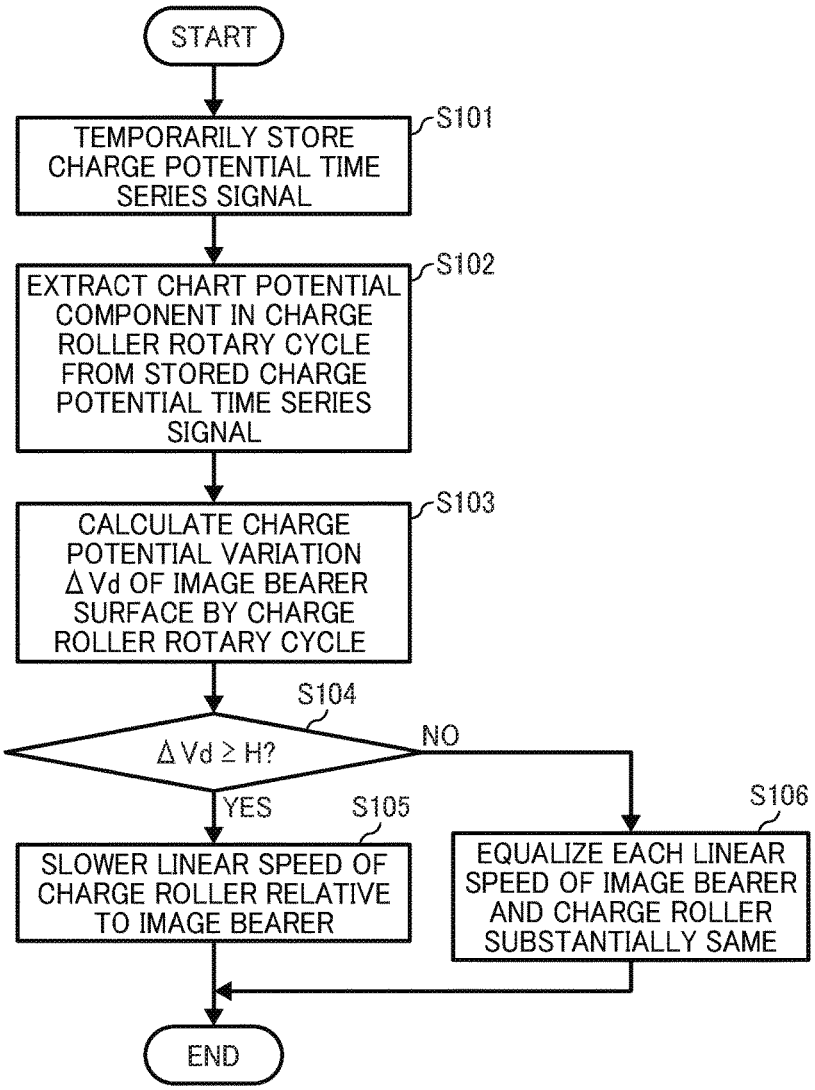
FIG. 25 is a flowchart illustrating a mode change process of a rotational speed of the charging roller based on the amount of variation in the charge potential due to the charging roller rotary cycle according to the present embodiment.

FIG. 25 is a flowchart illustrating a mode change process of a rotational speed of the charging roller based on the amount of variation in the charge potential due to the charging roller rotary cycle according to the present embodiment.

First, the image bearer 32 and the charging roller 13A are rotated, the charging bias is applied to the charging roller 13A, the surface of the image bearer 32 is charged, and the potential sensor 126 detects a signal of the charge potential of the image bearer 32. The potential sensor 126 detects chronological change in the charge potential of the image bearer and the chronological signal is stored temporarily in the signal memory (in step S101). The chronological signal includes, other than the charge variation in the rotary cycle of the charging roller, the charge variation in the image bearer in the rotary cycle, and charge variation components of various rotary cycles due to influences of parts related to image formation disposed around the image bearer. To calculate the charge variation affected by only the charging roller, the chronological signal of the charge potential in the rotary cycle of the charging roller is extracted from the chronological signal of the charge potential (in step S102). After the chronological signal of the charge potential in the rotary cycle of the charging roller has been extracted, a variation amount Vd (identical to the charge variation) of the charge potential in the rotary cycle of the charging roller is calculated (in step S103).

Next, after calculation of the variation amount Vd of the charge potential in the rotary cycle of the charging roller, the variation amount Vd and the previously set threshold H are compared. The threshold H depends on whether the charge variation is apparent in the formed image at the rotary cycle of the charging roller. In manufacturing the image forming apparatus, the threshold H is a value at which the charge variation becomes apparent in the formed image at the rotary cycle of the charging roller (in step S104). When the variation amount Vd exceeds the threshold H, it is determined that the amount of variation in the charge potential in the rotary cycle of the charging roller increases. In such a case, the rotation speed of the drive motor that drives the charging roller is lowered, and the linear speed of the charging roller is reduced (in step S104 and step S105). With this structure, the charge variation in the rotary cycle of the charging roller can be suppressed. On the other hand, when the variation amount Vd is less than the threshold H, it is determined that the amount of variation in the charge potential in the rotary cycle of the charging roller is low, so that the charging roller and the image bearer rotates at a substantially similar linear speed (in step S106).

Thus, by switching the mode of the rotational speed of the charging roller, the load of the driving motor of the charging roller can be reduced while variation in the charge potential in the rotary cycle of the charging roller is being suppressed. In addition, in the non-contact charging method to provide a gap between the circumferential surface of the image bearer and that of the charging roller, the abrasion status of the contact portion between the circumferential surface of the gap roller disposed integrally with the rotary shaft of the charging roller and the circumferential surface of the image bearer becomes moderated. With this structure, the abrasion due to slidable contact of the contact portion decreases. As a result, the lifetime of the image bearer can be extended. In the contact charging method in which the image bearer is charged due to the contact between the circumferential surface of the image bearer and that of the charging roller, the linear speed of the charging roller is changed so that the linear speed of the image bearer and the charging roller becomes substantially the same. With this structure, the slidable contact of the contact portion between the circumferential surface of the image bearer and that of the charging roller decreases, so that the abrasion of the contact portion due to the slidable contact can be reduced. As a result, the lifetime of the charging roller and the image bearer can be extended.

The aforementioned third to fifth embodiments are examples and specific effects can be obtained for each of the following aspects of (A) to (G):

<Aspect A>

An image forming apparatus 1 is provided, in which the rotational speed of the charging member such as the charging roller 13A can be switched during image forming operation, the rotational speed of the charging roller 13A is controlled such that the linear speed of the charging roller 13A is decreased to slower than the linear speed of the image bearer 32 only when the charge variation occurs, and the linear speed of the charging roller 13A is brought to the same as that of the image bearer 32 when no charge variation occurs. The lower speed or the first rotational speed and the same speed or the second rotational speed are switchable.

According to the present aspect, for example, when the amount of variation in the charge potential of the surface of the image bearer 32 in the rotary cycle of the charging roller exceeds a predetermined threshold, the rotational speed of the charging roller is changed to the first rotational speed by a charging roller controller, and the linear speed of the charging roller is made slower than the linear speed of the image bearer 32. As a result, the rotary cycle of the charging roller relative to the image bearer becomes longer. Compared to a case in which the rotary cycle is not lengthened, the variation gradient of the charge potential in the rotary cycle of the charging roller becomes moderate and the variation in the charge potential on the surface of the image bearer in the rotary cycle of the charging roller can be suppressed. Because the rotational speed of the charging roller becomes low, the load applied to the drive motor to rotate the charging roller can be reduced. On the other hand, when the amount of variation in the charge potential of the surface of the image bearer 32 in the rotary cycle of the charging roller is lower than the threshold, the rotational speed of the charging roller is changed to the second rotational speed by the charging roller controller, and the linear speed of the charging roller is made equivalent to the linear speed of the image bearer 32. Accordingly, the load to the drive motor is further lightened. Thus, by switching the rotational speed of the charging roller, the load of the drive motor of the charging roller can be reduced while variation in the charge potential in the rotary cycle the charging roller is being suppressed.

<Aspect B>

In Aspect A, the image forming apparatus further includes a potential sensor 126 to detect a surface potential of the image bearer, and the charge potential variation amount calculator 320 to calculate the amount of variation in the charge potential of the surface of the image bearer in the rotary cycle of the charging roller based on the surface potential of the image bearer detected by the potential sensor 126, in which the charging roller controller switches the rotational speed of the charging roller between the first rotational speed and the second rotational speed depending on the amount of variation in the charge potential on the surface of the image bearer in the rotary cycle of the charging roller.

According to the present aspect, for example, only when the amount of variation in the charge potential of the surface of the image bearer 32 in the rotary cycle of the charging roller exceeds a predetermined threshold greatly, the rotational speed of the charging roller is made slower than the linear speed of the image bearer 32. With this structure, unnecessarily sliding contact between the charging roller and the image bearer can be prevented and the lifetime of the charging roller and the image bearer can be extended.

<Aspect C>

In Aspect A or B, the charging roller controller switches the rotational speed of the charging roller to the first rotational speed when the amount of variation in the charge potential of the surface of the image bearer in the rotary cycle of the charging roller calculated by the surface potential variation amount calculator exceeds the threshold, and to the second rotational speed when the amount of variation in the charge potential on the surface of the image bearer in the rotary cycle of the charging roller is lower than the threshold. According to the present aspect, only when the amount of variation in the charge potential of the surface of the image bearer 32 in the rotary cycle of the charging roller exceeds a predetermined threshold greatly, the rotational speed of the charging roller is made slower than the linear speed of the image bearer 32. With this structure, unnecessarily sliding contact between the charging roller and the image bearer can be prevented and the lifetime of the charging roller and the image bearer can be extended.

<Aspect D>

In aspect A, B, or C, the image forming apparatus includes at least two process cartridges each including an image bearer, a charger, and a developing device. Accordingly, the present embodiment can be applied to the image forming apparatus including two or more process cartridges, and the charge potential variation on the surface of the image bearer in the rotary cycle of the charging roller can be suppressed.

<Aspect E>

In Aspect D, the charging roller controller switches the rotational speed of the charging roller to the first rotational speed with use of only a process cartridge in which the amount of variation in the charge potential of the surface of the image bearer in the rotary cycle of the charging roller calculated by the surface potential variation amount calculator exceeds the threshold. With this structure, the linear speed of the charging roller included in only the process cartridge in which the charge potential variation in the circumferential direction due to the charge potential variation in the surface of the image bearer in the rotary cycle of the charging roller has been detected, is changed. With this structure, the abrasion between the charging roller and the image bearer can be minimized among the whole apparatus.

<Aspect F>

In each of Aspects A to E, the image forming apparatus further includes a drive motor to rotatably drive the charging roller, which is disposed inside the apparatus body of the image forming apparatus other than the process cartridge. The image bearer and the charger disposed in the process cartridge is attachably detachable from the image forming apparatus, and can be replaced as a part due to expiration of lifetime. As a result, when a drive motor of the process cartridge is disposed in the process cartridge, the drive motor is replaced at a time of maintenance of the process cartridge. According to the present embodiment, because the charging roller drive motor is disposed to the apparatus body of the image forming apparatus, the replacement of the charging roller drive motor is not conducted together with the process cartridge at the same time.

<Aspect G>

In each of Aspects A to F, the charge potential variation amount calculator 320 calculates the amount of variation in the charge potential of the surface of the image bearer in the rotary cycle of the charging roller based on the signal extracting the rotary cycle component of the charging roller from the chronological signal of the surface potential of the image bearer detected by the surface potential sensor. The chronological signal of the surface potential of the image bearer includes, other than the charge variation in the rotary cycle of the charging roller, charge variation components of various rotary cycles due to influences of parts related to image formation disposed around the image bearer. According to the present embodiment, the chronological signal of the charge potential on the surface of the image bearer in the rotary cycle of the charging roller is extracted from the chronological signal of the charge potential, the charge variation can be calculated due to effects from the charging roller alone.

Additional modifications and variations in the present invention are possible in light of the above teachings. It is therefore to be understood that, within the scope of the appended claims, the invention may be practiced other than as specifically described herein.

What is claimed is:

1. An image forming apparatus comprising:

a process cartridge including:

an image bearer including a first rotary shaft and rotate about the first rotary shaft;

a charger to charge a surface of the image bearer; and a developing device to develop an electrostatic latent image formed on the image bearer as a visible toner image, wherein the charger includes a charging roller, the charging roller rotates about a second rotary shaft together with the image bearer during image formation, and electrically charges a surface of the image bearer, wherein a predetermined gap is formed between the image bearer and the charging roller, wherein a first gear disposed on the first rotary shaft of the image bearer is joined with a second gear disposed at one end of the second rotary shaft of the charging roller, wherein a gear ratio between the first gear and the second gear is set to a predetermined value so that a surface linear speed of the charging roller is slower than a surface linear speed of the image bearer.

2. The image forming apparatus as claimed in claim 1, further comprising a rotary position detector to detect a rotary position of the image bearer, wherein a rotary cycle of the charging roller is an integral multiple of the rotary cycle of the image bearer.

3. An image forming apparatus as claimed in claim 1, further comprising a third gear disposed at one end of the first rotary shaft that is joined to a drive motor that rotates the first rotary shaft by a driving force.

4. The image forming apparatus as claimed in claim 1, further comprising at least another process cartridge.

5. The image forming apparatus as claimed in claim 4, further comprising a drive motor to rotatably drive the charging roller, wherein the drive motor is disposed inside the apparatus body of the image forming apparatus at a position other than the process cartridge.

6. An image forming apparatus comprising:

a charging roller to rotate at a rotational speed;

an image bearer to rotate at a rotational speed; and a charging roller controller to switch the rotational speed of the charging roller between a first rotational speed and a second rotational speed during image formation, wherein the charging roller controller switches the rotational speed of the charging roller to the first rotational speed slower than the linear speed of the image bearer and the second rotational speed identical to the linear speed of the image bearer.

7. The image forming apparatus as claimed in claim 6, further comprising:

a potential sensor to detect a surface potential of the image bearer; and a charge potential variation amount calculator to calculate an amount of variation in a charge potential of a surface of the image bearer in a rotary cycle of the charging roller based on the surface potential of the image bearer detected by the potential sensor, wherein the charging roller controller switches the rotational speed of the charging roller between the first rotational speed and the second rotational speed in accordance with the amount of variation in the charge potential of the surface of the image bearer in the rotary cycle of the charging roller.

8. The image forming apparatus as claimed in claim 7, wherein the charging roller controller switches the rotational speed of the charging roller to the first rotational speed when the amount of variation in the charge potential of the surface of the image bearer in the rotary cycle of the charging roller calculated by the charge potential variation amount calculator is a threshold or greater, and switches the rotational speed of the charging roller to the second rotational speed when the amount of variation in the charge potential on the surface of the image bearer in the rotary cycle of the charging roller is lower than the threshold.

9. The image forming apparatus as claimed in claim 8, wherein the charging roller controller switches the rotational speed of the charging roller to the first rotational speed only for a process cartridge in which the amount of variation in the charge potential of the surface of the image bearer in the rotary cycle of the charging roller calculated by the charge potential variation amount calculator is the threshold or greater.

10. The image forming apparatus as claimed in claim 7, wherein the charge potential variation amount calculator calculates the amount of variation in the charge potential of the surface of the image bearer in the rotary cycle of the charging roller based on a signal obtained by extracting a rotary cycle component of the charging roller from a chronological signal representing the surface potential of the image bearer detected by the potential sensor.

* * * * *